US010526541B2

(12) United States Patent
West et al.

(10) Patent No.: US 10,526,541 B2
(45) **Date of Patent: *Jan. 7, 2020**

(54) HORIZONTAL HEAT RECOVERY COKE OVENS HAVING MONOLITH CROWNS

(71) Applicant: SUNCOKE TECHNOLOGY AND DEVELOPMENT LLC, Lisle, IL (US)

(72) Inventors: Gary Dean West, Lisle, IL (US); John Francis Quanci, Haddonville, NJ (US)

(73) Assignee: SUNCOKE TECHNOLOGY AND DEVELOPMENT LLC, Lisle, IL (US)

( * ) Notice: Subject to any disclaimer, the term of this patent is extended or adjusted under 35 U.S.C. 154(b) by 110 days.

This patent is subject to a terminal disclaimer.

(21) Appl. No.: 15/322,176

(22) PCT Filed: Jun. 30, 2015

(86) PCT No.: PCT/US2015/038663

§ 371 (c)(1),
(2) Date: Dec. 27, 2016

(87) PCT Pub. No.: WO2016/004106

PCT Pub. Date: Jan. 7, 2016

(65) Prior Publication Data

US 2017/0137714 A1 May 18, 2017

Related U.S. Application Data

(60) Provisional application No. 62/019,385, filed on Jun. 30, 2014.

(51) Int. Cl.
*C10B 29/02* (2006.01)
*C10B 15/02* (2006.01)
(Continued)

(52) U.S. Cl.
CPC ..... *C10B 29/02* (2013.01); *C10B 5/06* (2013.01); *C10B 15/02* (2013.01); *C10B 29/04* (2013.01)

(58) Field of Classification Search
CPC ..... C10B 15/02; C10B 21/00; C10B 21/10; C10B 29/00; C10B 29/04; C10B 29/06;
(Continued)

(56) References Cited

U.S. PATENT DOCUMENTS 425,797 A 4/1890 Hunt
469,868 A 3/1892 Osbourn
(Continued)

FOREIGN PATENT DOCUMENTS

CA 1172895 8/1984
CA 2775992 5/2011
(Continued)

OTHER PUBLICATIONS

U.S. Appl. No. 15/614,525, filed Jun. 5, 2017, Quanci et al.
(Continued)

*Primary Examiner* — Jonathan Miller
(74) *Attorney, Agent, or Firm* — Perkins Coie LLP

(57) ABSTRACT

The present technology is generally directed to horizontal heat recovery and non-heat recovery coke ovens having monolith crowns. In some embodiments, an HHR coke oven includes a monolith crown that spans the width of the oven between opposing oven sidewalls. The monolith expands upon heating and contracts upon cooling as a single structure. In further embodiments, the crown comprises a thermally-volume-stable material. The crown may be an oven crown, an upcommer arch, a downcommer arch, a J-piece, a single sole flue arch or multiple sole flue arches, a downcommer cleanout, curvilinear corner sections, and/or combined portions of any of the above sections. In some
(Continued)

embodiments, the crown is formed at least in part with a thermally-volume-stable material. In further embodiments, the crown is formed as a monolith (or several monolith segments) spanning between supports such as oven side-walls. In various embodiments, the monolith and thermally-volume-stable features can be used in combination or alone. These designs can allow the oven to be turned down below traditionally feasible temperatures while maintaining the structural integrity of the crown.

27 Claims, 18 Drawing Sheets

(51) Int. Cl.
*C10B 5/06* (2006.01)
*C10B 29/04* (2006.01)

(58) Field of Classification Search
CPC ... F27D 1/00; F27D 1/02; F27D 1/025; F27D 1/04; F27D 1/10
See application file for complete search history.

(56) References Cited

U.S. PATENT DOCUMENTS 845,719 A 2/1907 Schniewind
976,580 A 7/1909 Krause
1,140,798 A 5/1915 Carpenter
1,424,777 A 8/1922 Schondeling
1,430,027 A 9/1922 Plantinga
1,486,401 A 3/1924 Van Ackeren
1,530,995 A 3/1925 Geiger
1,572,391 A 2/1926 Kiaiber
1,677,973 A 7/1928 Marquard
1,705,039 A 3/1929 Thornhill
1,721,813 A 7/1929 Geipert
1,757,682 A 5/1930 Palm
1,818,370 A 8/1931 Wine
1,818,994 A 8/1931 Kreisinger
1,830,951 A 11/1931 Lovett
1,848,818 A 3/1932 Becker
1,947,499 A 2/1934 Schrader et al.
1,955,962 A 4/1934 Jones
2,075,337 A 3/1937 Burnaugh
2,141,035 A 12/1938 Daniels
2,394,173 A 2/1946 Harris et al.
2,424,012 A 7/1947 Bangham et al.
2,649,978 A 8/1953 Such
2,667,185 A 1/1954 Beavers
2,723,725 A 11/1955 Keiffer
2,756,842 A 7/1956 Chamberlin et al.
2,813,708 A 11/1957 Frey
2,827,424 A 3/1958 Homan
2,873,816 A 2/1959 Emil et al.
2,902,991 A 9/1959 Whitman
2,907,698 A 10/1959 Schulz
3,015,893 A 1/1962 McCreary
3,033,764 A 5/1962 Hannes
3,224,805 A 12/1965 Clyatt
3,462,345 A 8/1969 Kernan
3,511,030 A 5/1970 Brown et al.
3,542,650 A 11/1970 Kulakov
3,545,470 A 12/1970 Paton
3,592,742 A 7/1971 Thompson
3,616,408 A 10/1971 Hickam
3,623,511 A 11/1971 Levin
3,630,852 A 12/1971 Nashan et al.
3,652,403 A 3/1972 Knappstein et al.
3,676,305 A 7/1972 Cremer
3,709,794 A 1/1973 Kinzler et al.
3,710,551 A 1/1973 Sved
3,746,626 A 7/1973 Morrison, Jr.
3,748,235 A 7/1973 Pries
3,784,034 A 1/1974 Thompson
3,806,032 A 4/1974 Pries
3,811,572 A 5/1974 Tatterson
3,836,161 A 10/1974 Pries
3,839,156 A 10/1974 Jakobi et al.
3,844,900 A 10/1974 Schulte
3,857,758 A 12/1974 Mole
3,875,016 A 4/1975 Schmidt-Balve
3,876,143 A 4/1975 Rossow et al.
3,876,506 A 4/1975 Dix et al.
3,878,053 A 4/1975 Hyde
3,894,302 A 7/1975 Lasater
3,897,312 A 7/1975 Armour et al.
3,906,992 A 9/1975 Leach
3,912,091 A 10/1975 Thompson
3,917,458 A 11/1975 Polak
3,928,144 A 12/1975 Jakimowicz
3,930,961 A 1/1976 Sustarsic et al.
3,957,591 A 5/1976 Riecker
3,959,084 A 5/1976 Price
3,963,582 A 6/1976 Helm et al.
3,969,191 A 7/1976 Bollenbach
3,975,148 A 8/1976 Fukuda et al.
3,984,289 A 10/1976 Sustarsic et al.
4,004,702 A 1/1977 Szendroi
4,004,983 A 1/1977 Pries
4,025,395 A 5/1977 Ekholm et al.
4,040,910 A 8/1977 Knappstein et al.
4,045,299 A 8/1977 McDonald
4,059,885 A 11/1977 Oldengott
4,067,462 A 1/1978 Thompson
4,083,753 A 4/1978 Rogers et al.
4,086,231 A 4/1978 Ikio
4,093,245 A 6/1978 Connor
4,100,033 A 7/1978 Holter
4,111,757 A 9/1978 Carimboli
4,124,450 A 11/1978 MacDonald
4,135,948 A 1/1979 Mertens et al.
4,141,796 A 2/1979 Clark et al.
4,145,195 A 3/1979 Knappstein et al.
4,147,230 A 4/1979 Ormond et al.
4,162,546 A 7/1979 Shortell et al.
4,181,459 A 1/1980 Price
4,189,272 A 2/1980 Gregor et al.
4,194,951 A 3/1980 Pries
4,196,053 A 4/1980 Grohmann
4,211,608 A 7/1980 Kwasnoski et al.
4,211,611 A 7/1980 Bocsanczy
4,213,489 A 7/1980 Cain
4,213,828 A 7/1980 Calderon
4,222,748 A 9/1980 Argo et al.
4,225,393 A 9/1980 Gregor et al.
4,235,830 A 11/1980 Bennett et al.
4,239,602 A 12/1980 La Bate
4,248,671 A 2/1981 Belding
4,249,997 A 2/1981 Schmitz
4,263,099 A 4/1981 Porter
4,268,360 A 5/1981 Tsuzuki et al.
4,271,814 A 6/1981 Lister
4,284,478 A 8/1981 Brommel
4,285,772 A 8/1981 Kress
4,287,024 A 9/1981 Thompson
4,289,584 A 9/1981 Chuss et al.
4,289,585 A 9/1981 Wagener et al.
4,296,938 A 10/1981 Offermann et al.
4,299,666 A 11/1981 Ostmann
4,302,935 A 12/1981 Cousimano
4,303,615 A 12/1981 Jarmell et al.
4,307,673 A 12/1981 Caughey
4,314,787 A 2/1982 Kwasnik et al.
4,330,372 A 5/1982 Cairns et al.
4,334,963 A 6/1982 Stog
4,336,843 A 6/1982 Petty
4,340,445 A 7/1982 Kucher et al.
4,342,195 A 8/1982 Lo
4,344,820 A 8/1982 Thompson
4,344,822 A 8/1982 Schwartz et al.
4,353,189 A 10/1982 Thiersch et al.
4,366,029 A 12/1982 Bixby et al.

(56) References Cited

U.S. PATENT DOCUMENTS 4,373,244 A 2/1983 Mertens et al.
4,375,388 A 3/1983 Hara et al.
4,391,674 A 7/1983 Velmin et al.
4,392,824 A 7/1983 Struck et al.
4,394,217 A 7/1983 Holz et al.
4,395,269 A 7/1983 Schuler
4,396,394 A 8/1983 Li et al.
4,396,461 A 8/1983 Neubaum et al.
4,431,484 A 2/1984 Weber et al.
4,439,277 A 3/1984 Dix
4,440,098 A 4/1984 Adams
4,445,977 A 5/1984 Husher
4,446,018 A 5/1984 Cerwick
4,448,541 A 5/1984 Lucas
4,452,749 A 6/1984 Kolvek et al.
4,459,103 A 7/1984 Gieskieng
4,469,446 A 9/1984 Goodboy
4,474,344 A 10/1984 Bennett
4,487,137 A 12/1984 Horvat et al.
4,498,786 A 2/1985 Ruscheweyh
4,506,025 A * 3/1985 Kleeb ..... C04B 35/14 501/124
4,508,539 A 4/1985 Nakai
4,527,488 A 7/1985 Lindgren
4,564,420 A 1/1986 Spindeler et al.
4,568,426 A 2/1986 Orlando
4,570,670 A 2/1986 Johnson
4,614,567 A 9/1986 Stahlherm et al.
4,643,327 A 2/1987 Campbell
4,645,513 A 2/1987 Kubota et al.
4,655,193 A 4/1987 Blacket
4,655,804 A 4/1987 Kercheval et al.
4,666,675 A 5/1987 Parker et al.
4,680,167 A 7/1987 Orlando
4,704,195 A 11/1987 Janicka et al.
4,720,262 A 1/1988 Durr et al.
4,724,976 A 2/1988 Lee
4,726,465 A 2/1988 Kwasnik et al.
4,793,981 A 12/1988 Doyle et al.
4,824,614 A 4/1989 Jones et al.
4,889,698 A 12/1989 Moller et al.
4,919,170 A 4/1990 Kallinich et al.
4,929,179 A 5/1990 Breidenbach et al.
4,941,824 A 7/1990 Holter et al.
5,052,922 A 10/1991 Stokman et al.
5,062,925 A 11/1991 Durselen et al.
5,078,822 A 1/1992 Hodges et al.
5,087,328 A 2/1992 Wegerer et al.
5,114,542 A 5/1992 Childress et al.
5,213,138 A 5/1993 Presz
5,227,106 A 7/1993 Kolvek
5,228,955 A 7/1993 Westbrook, III
5,234,601 A 8/1993 Janke et al.
5,318,671 A 6/1994 Pruitt
5,370,218 A 12/1994 Johnson et al.
5,423,152 A 6/1995 Kolvek
5,447,606 A 9/1995 Pruitt
5,542,650 A 8/1996 Abel et al.
5,622,280 A 4/1997 Mays et al.
5,659,110 A 8/1997 Herden et al.
5,670,025 A 9/1997 Baird
5,687,768 A 11/1997 Albrecht et al.
5,715,962 A 2/1998 McDonnell
5,752,548 A 5/1998 Matsumoto et al.
5,787,821 A 8/1998 Bhat et al.
5,810,032 A 9/1998 Hong et al.
5,816,210 A 10/1998 Yamaguchi
5,857,308 A 1/1999 Dismore et al.
5,913,448 A 6/1999 Mann et al.
5,928,476 A 7/1999 Daniels
5,968,320 A 10/1999 Sprague
6,017,214 A 1/2000 Sturgulewski
6,059,932 A 5/2000 Sturgulewski
6,139,692 A 10/2000 Tamura et al.
6,152,668 A 11/2000 Knoch
6,187,148 B1 2/2001 Sturgulewski
6,189,819 B1 2/2001 Racine
6,290,494 B1 9/2001 Barkdoll
6,412,221 B1 7/2002 Emsbo
6,596,128 B2 * 7/2003 Westbrook ..... C10B 9/00 201/13
6,626,984 B1 9/2003 Taylor
6,699,035 B2 3/2004 Brooker
6,758,875 B2 7/2004 Reid et al.
6,907,895 B2 6/2005 Johnson et al.
6,946,011 B2 9/2005 Snyder
6,964,236 B2 11/2005 Schucker
7,056,390 B2 6/2006 Fratello
7,077,892 B2 7/2006 Lee
7,314,060 B2 1/2008 Chen et al.
7,331,298 B2 2/2008 Barkdoll et al.
7,433,743 B2 10/2008 Pistikopoulos et al.
7,497,930 B2 3/2009 Barkdoll et al.
7,611,609 B1 11/2009 Valia et al.
7,644,711 B2 1/2010 Creel
7,722,843 B1 5/2010 Srinivasachar
7,727,307 B2 6/2010 Winkler
7,785,447 B2 8/2010 Eatough et al.
7,803,627 B2 9/2010 Hodges et al.
7,823,401 B2 11/2010 Takeuchi et al.
7,827,689 B2 11/2010 Crane
7,998,316 B2 8/2011 Barkdoll
8,071,060 B2 12/2011 Ukai et al.
8,079,751 B2 12/2011 Kapila et al.
8,080,088 B1 12/2011 Srinivasachar
8,152,970 B2 4/2012 Barkdoll et al.
8,236,142 B2 8/2012 Westbrook
8,266,853 B2 9/2012 Bloom et al.
8,398,935 B2 3/2013 Howell et al.
8,409,405 B2 4/2013 Kim et al.
8,647,476 B2 2/2014 Kim et al.
8,800,795 B2 8/2014 Hwang
8,956,995 B2 2/2015 Masatsugu et al.
8,980,063 B2 3/2015 Kim et al.
9,039,869 B2 5/2015 Kim et al.
9,057,023 B2 6/2015 Reichelt et al.
9,238,778 B2 1/2016 Quanci et al.
9,243,186 B2 1/2016 Quanci et al.
9,249,357 B2 2/2016 Quanci et al.
10,323,192 B2 6/2019 Quanci et al.
2002/0170605 A1 11/2002 Shiraishi et al.
2003/0014954 A1 1/2003 Ronning et al.
2003/0015809 A1 1/2003 Carson
2003/0057083 A1 3/2003 Eatough et al.
2005/0087767 A1 4/2005 Fitzgerald et al.
2006/0102420 A1 5/2006 Huber et al.
2006/0149407 A1 7/2006 Markham et al.
2007/0116619 A1 5/2007 Taylor et al.
2007/0251198 A1 11/2007 Witter
2008/0028935 A1 2/2008 Andersson
2008/0169578 A1 * 7/2008 Crane ..... C10B 29/02 264/30
2008/0179165 A1 7/2008 Chen et al.
2008/0257236 A1 10/2008 Green
2008/0271985 A1 11/2008 Yamasaki
2008/0289305 A1 11/2008 Girondi
2009/0007785 A1 1/2009 Kimura et al.
2009/0162269 A1 6/2009 Barger et al.
2009/0217576 A1 9/2009 Kim et al.
2009/0283395 A1 11/2009 Hippe
2010/0095521 A1 4/2010 Kartal et al.
2010/0113266 A1 5/2010 Abe et al.
2010/0115912 A1 5/2010 Worley
2010/0181297 A1 7/2010 Whysail
2010/0196597 A1 8/2010 Di Loreto
2010/0276269 A1 11/2010 Schuecker et al.
2010/0287871 A1 11/2010 Bloom et al.
2010/0314234 A1 12/2010 Knoch et al.
2011/0048917 A1 3/2011 Kim et al.
2011/0088600 A1 4/2011 McRae
2011/0144406 A1 6/2011 Masatsugu et al.
2011/0168482 A1 7/2011 Merchant et al.
2011/0174301 A1 7/2011 Haydock et al.
2011/0198206 A1 8/2011 Kim et al.

(56) References Cited

U.S. PATENT DOCUMENTS

| | | | |
|---|---|---|---|
| 2011/0223088 | A1 | 9/2011 | Chang et al. |
| 2011/0253521 | A1 | 10/2011 | Kim |
| 2011/0291827 | A1 | 12/2011 | Baldocchi et al. |
| 2011/0313218 | A1 | 12/2011 | Dana |
| 2012/0024688 | A1 | 2/2012 | Barkdoll |
| 2012/0030998 | A1 | 2/2012 | Barkdoll et al. |
| 2012/0125709 | A1 | 5/2012 | Merchant et al. |
| 2012/0152720 | A1 | 6/2012 | Reichelt et al. |
| 2012/0180133 | A1 | 7/2012 | Al-Harbi et al. |
| 2012/0228115 | A1 | 9/2012 | Westbrook |
| 2012/0247939 | A1 | 10/2012 | Kim et al. |
| 2013/0020781 | A1 | 1/2013 | Kishikawa |
| 2013/0045149 | A1 | 2/2013 | Miller |
| 2013/0216717 | A1 | 8/2013 | Rago et al. |
| 2013/0220373 | A1 | 8/2013 | Kim |
| 2013/0306462 | A1 | 11/2013 | Kim et al. |
| 2014/0033917 | A1 | 2/2014 | Rodgers et al. |
| 2014/0039833 | A1 | 2/2014 | Sharpe, Jr. et al. |
| 2014/0048402 | A1 | 2/2014 | Quanci et al. |
| 2014/0061018 | A1 | 3/2014 | Sarpen et al. |
| 2014/0083836 | A1 | 3/2014 | Quanci et al. |
| 2014/0182195 | A1 | 7/2014 | Quanci et al. |
| 2014/0182683 | A1 | 7/2014 | Quanci et al. |
| 2014/0183023 | A1 | 7/2014 | Quanci et al. |
| 2014/0183024 | A1 | 7/2014 | Chun et al. |
| 2014/0208997 | A1 | 7/2014 | Alferyev et al. |
| 2014/0224123 | A1 | 8/2014 | Walters |
| 2014/0262139 | A1 | 9/2014 | Choi et al. |
| 2014/0262726 | A1 | 9/2014 | West et al. |
| 2015/0122629 | A1 | 5/2015 | Freimuth et al. |
| 2015/0219530 | A1 | 8/2015 | Li et al. |
| 2015/0247092 | A1 | 9/2015 | Quanci et al. |
| 2015/0287026 | A1 | 10/2015 | Quanci et al. |
| 2016/0026193 | A1 | 1/2016 | Rhodes et al. |
| 2016/0032193 | A1 | 2/2016 | Sarpen et al. |
| 2016/0048139 | A1 | 2/2016 | Samples et al. |
| 2016/0060532 | A1 | 3/2016 | Quanci et al. |
| 2016/0060533 | A1 | 3/2016 | Quanci et al. |
| 2016/0060534 | A1 | 3/2016 | Quanci et al. |
| 2016/0060536 | A1 | 3/2016 | Quanci et al. |
| 2016/0149944 | A1 | 5/2016 | Obermeier et al. |
| 2016/0152897 | A1 | 6/2016 | Quanci et al. |
| 2016/0160123 | A1 | 6/2016 | Quanci et al. |
| 2016/0186063 | A1 | 6/2016 | Quanci et al. |
| 2016/0186064 | A1 | 6/2016 | Quanci et al. |
| 2016/0186065 | A1 | 6/2016 | Quanci et al. |
| 2016/0222297 | A1 | 8/2016 | Choi et al. |
| 2016/0319197 | A1 | 11/2016 | Quanci et al. |
| 2016/0319198 | A1 | 11/2016 | Quanci et al. |
| 2017/0015908 | A1 | 1/2017 | Quanci et al. |
| 2017/0025803 | A1 | 9/2017 | Quanci et al. |
| 2017/0025804 | A1 | 9/2017 | Quanci et al. |

FOREIGN PATENT DOCUMENTS

| | | | |
|---|---|---|---|
| CA | 2822841 | | 7/2012 |
| CA | 2822857 | | 7/2012 |
| CN | 87212113 | U | 6/1988 |
| CN | 87107195 | A | 7/1988 |
| CN | 2064363 | U | 10/1990 |
| CN | 2139121 | Y | 7/1993 |
| CN | 1092457 | A | 9/1994 |
| CN | 1255528 | A | 6/2000 |
| CN | 1270983 | A | 10/2000 |
| CN | 2528771 | Y | 2/2002 |
| CN | 1358822 | A | 7/2002 |
| CN | 2521473 | Y | 11/2002 |
| CN | 1468364 | A | 1/2004 |
| CN | 1527872 | A | 9/2004 |
| CN | 2668641 | | 1/2005 |
| CN | 1957204 | A | 5/2007 |
| CN | 101037603 | A | 9/2007 |
| CN | 101058731 | A | 10/2007 |
| CN | 101157874 | A | 4/2008 |
| CN | 201121178 | Y | 9/2008 |
| CN | 101395248 | A | 3/2009 |
| CN | 100510004 | C | 7/2009 |
| CN | 101486017 | A | 7/2009 |
| CN | 201264981 | Y | 7/2009 |
| CN | 101497835 | A | 8/2009 |
| CN | 101509427 | A | 8/2009 |
| CN | 102155300 | A | 8/2011 |
| CN | 2509188 | Y | 11/2011 |
| CN | 202226816 | | 5/2012 |
| CN | 202265541 | U | 6/2012 |
| CN | 102584294 | A | 7/2012 |
| CN | 202415446 | U | 9/2012 |
| CN | 103468289 | A | 12/2013 |
| CN | 105189704 | A | 12/2015 |
| CN | 106661456 | A | 5/2017 |
| DE | 201729 | C | 9/1908 |
| DE | 212176 | | 7/1909 |
| DE | 1212037 | B | 3/1966 |
| DE | 3231697 | C1 | 1/1984 |
| DE | 3328702 | A1 | 2/1984 |
| DE | 3315738 | C2 | 3/1984 |
| DE | 3329367 | C | 11/1984 |
| DE | 3407487 | C1 | 6/1985 |
| DE | 19545736 | | 6/1997 |
| DE | 19803455 | | 8/1999 |
| DE | 10122531 | A1 | 11/2002 |
| DE | 10154785 | | 5/2003 |
| DE | 102005015301 | | 10/2006 |
| DE | 102006004669 | | 8/2007 |
| DE | 102006026521 | | 12/2007 |
| DE | 102009031436 | | 1/2011 |
| DE | 102011052785 | | 12/2012 |
| EP | 0126399 | A1 | 11/1984 |
| EP | 0208490 | | 1/1987 |
| EP | 0903393 | A2 | 3/1999 |
| EP | 2295129 | | 3/2011 |
| FR | 2339664 | | 8/1977 |
| GB | 364236 | A | 1/1932 |
| GB | 368649 | A | 3/1932 |
| GB | 441784 | | 1/1936 |
| GB | 606340 | | 8/1948 |
| GB | 611524 | | 11/1948 |
| GB | 725865 | | 3/1955 |
| GB | 871094 | | 6/1961 |
| GB | 923205 | A | 5/1963 |
| JP | S50148405 | | 11/1975 |
| JP | S59019301 | | 2/1978 |
| JP | 54054101 | | 4/1979 |
| JP | S5453103 | A | 4/1979 |
| JP | 57051786 | | 3/1982 |
| JP | 57051787 | | 3/1982 |
| JP | 57083585 | | 5/1982 |
| JP | 57090092 | | 6/1982 |
| JP | 58091788 | | 5/1983 |
| JP | 59051978 | | 3/1984 |
| JP | 59053589 | | 3/1984 |
| JP | 59071388 | | 4/1984 |
| JP | 59108083 | | 6/1984 |
| JP | 59145281 | | 8/1984 |
| JP | 60004588 | | 1/1985 |
| JP | 61106690 | | 5/1986 |
| JP | 62011794 | | 1/1987 |
| JP | 62285980 | | 12/1987 |
| JP | 01103694 | | 4/1989 |
| JP | 01249886 | | 10/1989 |
| JP | H0319127 | | 3/1991 |
| JP | 03197588 | | 8/1991 |
| JP | 04159392 | | 6/1992 |
| JP | H04178494 | A | 6/1992 |
| JP | H0649450 | A | 2/1994 |
| JP | H0654753 | U | 7/1994 |
| JP | H06264062 | | 9/1994 |
| JP | 07188668 | | 7/1995 |
| JP | 07216357 | | 8/1995 |
| JP | H07204432 | | 8/1995 |
| JP | H08104875 | A | 4/1996 |
| JP | 08127778 | | 5/1996 |
| JP | H10273672 | A | 10/1998 |
| JP | H11-131074 | | 5/1999 |

(56) References Cited

FOREIGN PATENT DOCUMENTS

| | | | |
|---|---|---|---|
| JP | 2000204373 | A | 7/2000 |
| JP | 2001200258 | | 7/2001 |
| JP | 2002106941 | | 4/2002 |
| JP | 2003041258 | | 2/2003 |
| JP | 2003071313 | | 3/2003 |
| JP | 2003292968 | A | 10/2003 |
| JP | 2003342581 | A | 12/2003 |
| JP | 2005503448 | A | 2/2005 |
| JP | 2005263983 | A | 9/2005 |
| JP | 2006188608 | A | 7/2006 |
| JP | 2007063420 | A | 3/2007 |
| JP | 2008231278 | A | 10/2008 |
| JP | 2009073864 | A | 4/2009 |
| JP | 2009073865 | A | 4/2009 |
| JP | 2009144121 | | 7/2009 |
| JP | 2010229239 | A | 10/2010 |
| JP | 2010248389 | A | 11/2010 |
| JP | 2012102302 | | 5/2012 |
| JP | 2013006957 | A | 1/2013 |
| JP | 2013510910 | | 3/2013 |
| JP | 2013189322 | A | 9/2013 |
| JP | 2014040502 | A | 3/2014 |
| KR | 1019960008754 | | 10/1996 |
| KR | 1019990054426 | | 7/1999 |
| KR | 20000042375 | A | 7/2000 |
| KR | 100296700 | B1 | 10/2001 |
| KR | 1020050053861 | A | 6/2005 |
| KR | 100737393 | B1 | 7/2007 |
| KR | 100797852 | | 1/2008 |
| KR | 20110010452 | A | 2/2011 |
| KR | 101314288 | | 4/2011 |
| KR | 20130050807 | | 5/2013 |
| KR | 101318388 | | 10/2013 |
| RU | 2441898 | C2 | 2/2012 |
| SU | 1535880 | A1 | 1/1990 |
| TW | 201241166 | A1 | 10/2012 |
| UA | 50580 | | 10/2002 |
| WO | WO9012074 | | 10/1990 |
| WO | WO9945083 | | 9/1999 |
| WO | WO2005023649 | | 3/2005 |
| WO | WO2005115583 | | 12/2005 |
| WO | WO2007103649 | | 9/2007 |
| WO | WO2008034424 | | 3/2008 |
| WO | WO2011000447 | | 1/2011 |
| WO | WO2012029979 | | 3/2012 |
| WO | WO2012031726 | | 3/2012 |
| WO | WO2013023872 | | 2/2013 |
| WO | WO2010107513 | | 9/2013 |
| WO | WO2014021909 | | 2/2014 |
| WO | WO2014105064 | | 7/2014 |
| WO | WO2014153050 | | 9/2014 |
| WO | WO2016004106 | | 1/2016 |

OTHER PUBLICATIONS

Brazilian Examination Report for Brazilian Application No. BR112015010451-7, dated Apr. 24, 2017, 3 pages.

Chinese Office Action in Chinese Application No. 201480014799.8, dated Mar. 13, 2017.

Chinese Office Action in Chinese Application No. 201480014799.8; dated Jul. 7, 2017.

"Conveyor Chain Designer Guild", Mar. 27, 2014 (date obtained from wayback machine), Renold.com, Section 4, available online at: http://www.renold/com/upload/renoldswitzerland/conveyor_chain_-_designer_guide.pdf.

Practical Technical Manual of Refractories, Baoyu Hu, etc., Bejing: Metallurgical Industry Press, Chapter 6; 2004, 6-30.

Refractories for Ironmaking and Steelmaking: A History of Battles over High Temperatures; Kyoshi Sugita (Japan, Shaolin Zhang), 1995, p. 160, 2004, 2-29.

"Middletown Coke Company HRSG Maintenance BACT Analysis Option 1—Individual Spray Quenches Sun Heat Recovery Coke Facility Process Flow Diagram Middletown Coke Company 100 Oven Case #1—24.5 VM", (Sep. 1, 2009), URL: http://web.archive.org/web/20090901042738/http://epa.ohio.gov/portals/27/transfer/ptiApplication/mcc/new/262504.pdf, (Feb. 12, 2016), XP055249803 [X] 1-13 * p. 7 * * pp. 8-11 *.

Walker D N et al, "Sun Coke Company's heat recovery cokemaking technology high coke quality and low environmental impact", Revue De Metallurgie—Cahiers D'Informations Techniques, Revue De Metallurgie. Paris, FR, (Mar. 1, 2003), vol. 100, No. 3, ISSN 0035-1563, p. 23.

U.S. Appl. No. 15/987,860, filed May 23, 2018, Crum et al.

U.S. Appl. No. 16/000,516, filed Jun. 5, 2018, Quanci.

Boyes, Walt. (2003), Instrumentation Reference Book (3rd Edition)—34.7.4.6 Infrared and Thermal Cameras, Elsevier. Online version available at: https://app.knovel.com/hotlink/pdf/id:kt004QMGV6/instrumentation-reference-2/ditigal-video.

Kerlin, Thomas (1999), Practical Thermocouple Thermometry—1.1 The Thermocouple. ISA. Online version available at https:app.knovel.com/pdf/id:kt007XPTM3/practical-thermocouple/the-thermocouple.

Madias, et al., "A review on stamped charging of coals" (2013). Available at https://www.researchgate.net/publicatoin/263887759_A_review_on_stamped_charging_of_coals.

Metallurgical Code MSDS, ArcelorMittal, May 30, 2011, available online at http://dofasco.arcelormittal.com/-/media/Files/A/Arcelormittal-Canada/material-safety/metallurgical-coke.pdf.

Extended European Search Report for European Application No. 15842460.6; dated May 18, 2018; 10 pages.

Bloom, et al., "Modular cast block—The future of coke oven repairs," Iron & Steel Technol, AIST, Warrendale, PA, vol. 4, No. 3, Mar. 1, 2007, pp. 61-64.

Chinese Decision of Rejection in Chinese Application No. 201480014799.8; dated Dec. 4, 2017; 18 pages.

Extended European Search Report for European Application No. 15815180.3; dated Jan. 22, 2018; 9 pages.

Examination Report for European Application No. 14769676.9; dated Nov. 13, 2017; 4 pages.

U.S. Appl. No. 15/392,942, filed Dec. 28, 2016, Quanci et al.

ASTM D5341-99(2010)e1, Standard Test Method for Measuring Coke Reactivity Index (CRI) and Coke Strength After Reaction (CSR), ASTM International, West Conshohocken, PA, 2010.

Basset et al., "Calculation of steady flow pressure loss coefficients for pipe junctions," Proc Instn Mech Engrs., vol. 215, Part C. IMechIE 2001.

Beckman et al., "Possibilities and limits of cutting back coking plant output," Stahl Und Eisen, Verlag Stahleisen, Dusseldorf, DE, vol. 130, No. 8, Aug. 16, 2010, pp. 57-67.

Canadian Office Action in Canadian Application No. 2,903,836, dated May 9, 2016, 6 pages.

Canadian Office Action in Canadian Application No. 2,903,836, dated Nov. 17, 2016, 4 pages.

Chinese Office Action in Chinese Application No. 201480014799.8, dated Jul. 14, 2016.

Clean coke process: process development studies by USS Engineers and Consultants, Inc., Wisconsin Tech Search, request date Oct. 5, 2011, 17 pages.

Costa, et al., "Edge Effects on the Flow Characteristics in a 90 deg Tee Junction," Transactions of the ASME, Nov. 2006, vol. 128, pp. 1204-1217.

Crelling, et al., "Effects of Weathered Coal on Coking Properties and Coke Quality", Fuel, 1979, vol. 58, Issue 7, pp. 542-546.

Database WPI, Week 199115, Thomson Scientific, Lond, GB; AN 1991-107552.

Diez, et al., "Coal for Metallurgical Coke Production: Predictions of Coke Quality and Future Requirements for Cokemaking", International Journal of Coal Geology, 2002, vol. 50, Issue 1-4, pp. 389-412.

Extended European Search Reportin European Patent Application No. 16161750.1, dated Aug. 19, 2016, 9 pages.

Extended European Search Report in European Application No. 14769676.9, dated Sep. 30, 2016, 7 pages.

(56) References Cited

OTHER PUBLICATIONS

International Search Report and Written Opinion of International Application No. PCT/US2014/028837; dated Aug. 21, 2014; 11 pages.
International Search Report and Written Opinion in International Application No. PCT/US2015/038663, dated Sep. 14, 2015, 14 pages.
International Search Report and Written Opinion in International Application No. PCT/US2015/050295, dated Nov. 17, 2015, 16 pages.
JP 03-197588, Inoue Keizo et al., Method and Equipment for Boring Degassing Hole in Coal Charge in Coke Oven, Japanese Patent (Abstract Only) Aug. 28, 1991.
JP 04-159392, Inoue Keizo et al., Method and Equipment for Opening Hole for Degassing of Coal Charge in Coke Oven, Japanese Patent (Abstract Only) Jun. 2, 1992.
Kochanski et al., "Overview of Uhde Heat Recoery Cokemaking Technology," AISTech Iron and Steel Technology Conference Proceedings, Association for Iron and Steel Technology, U.S., vol. 1, Jan. 1, 2005, pp. 25-32.
Rose, Harold J., "The Selection of Coals for the Manufacture of Coke," American Institute of Mining and Metallurgical Engineers, Feb. 1926, 8 pages.
Waddell, et al., "Heat-Recovery Cokemaking Presentation," Jan. 1999, pp. 1-25.
Westbrook, "Heat-Recovery Cokemaking at Sun Coke," AISE Steel Technology, Pittsburg, PA, vol. 76, No. 1, Jan. 1999, pp. 25-28.
Yu et al., "Coke Oven Production Technology," Lianoning Science and Technology Press, first edition, Apr. 2014, pp. 356-358.
"Resources and Utilization of Coking Coal in China," Mingxin SHEN ed., Chemical Industry Press, first edition, Jan. 2007, pp. 242-243, 247.
U.S. Appl. No. 16/026,363, filed Jul. 3, 2018, Chun et al.
U.S. Appl. No. 16/047,198, filed Jul. 27, 2018, Quanci et al.
Colombian Office Action in Colombian Patent Application No. NC2017/0000523; dated Jul. 17, 2018; 7 pages.
Astrom, et al., "Feedback Systems: An Introduction for Scientists and Engineers," Sep. 16, 2006, available on line at http://people/duke.edu/-hpgavin/SystemID/References/Astrom-Feedback-2006.pdf ; 404 pages.
Industrial Furnace Design Handbook, Editor-in-Chief: First Design Institute of First Ministry of Machinery Industry, Beijing: Mechanical Industry Press, pp. 180-183, Oct. 1981.
"What is dead-band control," forum post by user "wireaddict" on AllAboutCircuits.com message board, Feb. 8, 2007, accessed Oct. 24, 2018 at https:/forum.allaboutcircuits.com/threads/what-is-dead-band-control.4728/; 8 pages.
Chinese Office Action in Chinese Application No. 201610146244.X; dated Sep. 11, 2018; 20 pages.
Colombian Office Action in Colombian Patent No. NC2017/003281; dated Dec. 1, 2018; 13 pages.
Australian Examination Report No. 1 for Australian Application No. 2015284198; dated Dec. 21, 2018; 3 pages.
U.S. Appl. No. 07/587,742, filed Sep. 25, 1990, now U.S. Pat. No. 5,114,542, titled Nonrecovery Coke Oven Battery and Method of Operation.
U.S. Appl. No. 07/878,904, filed May 6, 1992, now U.S. Pat. No. 5,318,671, titled Method of Operation of Nonrecovery Coke Oven Battery.
U.S. Appl. No. 09/783,195, filed Feb. 14, 2001, now U.S. Pat. No. 6,596,128, titled Coke Oven Flue Gas Sharing.
U.S. Appl. No. 07/886,804, filed May 22, 1992, now U.S. Pat. No. 5,228,955, titled High Strength Coke Oven Wall Having Gas Flues Therein.
U.S. Appl. No. 08/059,673, filed May 12, 1993, now U.S. Pat. No. 5,447,606, titled Method of and Apparatus for Capturing Coke Oven Charging Emissions.
U.S. Appl. No. 08/914,140, filed Aug. 19, 1997, now U.S. Pat. No. 5,928,476, titled Nonrecovery Coke Oven Door.
U.S. Appl. No. 09/680,187, filed Oct. 5, 2000, now U.S. Pat. No. 6,290,494, titled Method and Apparatus for Coal Coking.
U.S. Appl. No. 10/933,866, filed Sep. 3, 2004, now U.S. Pat. No. 7,331,298, titled Coke Oven Rotary Wedge Door Latch.
U.S. Appl. No. 11/424,566, filed Jun. 16, 2006, now U.S. Pat. No. 7,497,930, titled Method and Apparatus for Compacting Coal for a Coal Coking Process.
U.S. Appl. No. 12/405,269, filed Mar. 17, 2009, now U.S. Pat. No. 7,998,316, titled Flat Push Coke Wet Quenching Apparatus and Process.
U.S. Appl. No. 13/205,960, filed Aug. 9, 2011, now U.S. Pat. No. 9,321,965, titled Flat Push Coke Wet Quenching Apparatus and Process.
U.S. Appl. No. 11/367,236, filed Mar. 3, 2006, now U.S. Pat. No. 8,152,970, titled Method and Apparatus for Producing Coke.
U.S. Appl. No. 12/403,391, filed Mar. 13, 2009, now U.S. Pat. No. 8,172,930, titled Cleanable In Situ Spark Arrestor.
U.S. Appl. No. 12/849,192, filed Aug. 3, 2010, now U.S. Pat. No. 9,200,225, titled Method and Apparatus for Compacting Coal for a Coal Coking Process.
U.S. Appl. No. 13/631,215, filed Sep. 28, 2012, now U.S. Pat. No. 9,683,740, titled Methods for Handling Coal Processing Emissions and Associated Systems and Devices.
U.S. Appl. No. 13/730,692, filed Dec. 28, 2012, now U.S. Pat. No. 9,193,913, titled Reduced Output Rate Coke Oven Operation with Gas Sharing Providing Extended Process Cycle.
U.S. Appl. No. 14/921,723, filed Oct. 23, 2015, titled Reduced Output Rate Coke Oven Operation with Gas Sharing Providing Extended Process Cycle.
U.S. Appl. No. 14/655,204, filed Jun. 24, 2015, titled Systems and Methods for Removing Mercury from Emissions.
U.S. Appl. No. 16/000,516, filed Jun. 5, 2018, titled Systems and Methods for Removing Mercury from Emissions.
U.S. Appl. No. 13/830,971, filed Mar. 14, 2013, now U.S. Pat. No. 10,047,296, titled Non-Perpendicular Connections Between Coke Oven Uptakes and a Hot Common Tunnel, and Associated Systems and Methods, now U.S. Pat. No. 10,047,295.
U.S. Appl. No. 16/026,363, filed Jul. 3, 2018, titled Non-Perpendicular Connections Between Coke Oven Uptakes and a Hot Common Tunnel, and Associated Systems and Methods.
U.S. Appl. No. 13/730,796, filed Dec. 28, 2012, titled Methods and Systems for Improved Coke Quenching.
U.S. Appl. No. 13/730,598, filed Dec. 28, 2012, now U.S. Pat. No. 9,238,778, titled Systems and Methods for Improving Quenched Coke Recovery.
U.S. Appl. No. 14/952,267, filed Nov. 25, 2015, now U.S. Pat. No. 9,862,888, titled Systems and Methods for Improving Quenched Coke Recovery.
U.S. Appl. No. 15/830,320, filed Dec. 4, 2017, now U.S. Pat. No. 10,323,192, titled Systems and Methods for Improving Quenched Coke Recovery.
U.S. Appl. No. 13/730,735, filed Dec. 28, 2012, now U.S. Pat. No. 9,273,249, titled Systems and Methods for Controlling Air Distribution in a Coke Oven.
U.S. Appl. No. 14/655,013, filed Jun. 23, 2015, titled Vent Stack Lids and Associated Systems and Methods.
U.S. Appl. No. 13/843,166, now U.S. Pat. No. 9,273,250, filed Mar. 15, 2013, titled Methods and Systems for Improved Quench Tower Design.
U.S. Appl. No. 15/014,547, filed Feb. 3, 2016, titled Methods and Systems for Improved Quench Tower Design.
U.S. Appl. No. 14/655,003, filed Jun. 23, 2015, titled Systems and Methods for Maintaining a Hot Car in a Coke Plant.
U.S. Appl. No. 13/829,588, now U.S. Pat. No. 9,193,915, filed Mar. 14, 2013, titled Horizontal Heat Recovery Coke Ovens Having Monolith Crowns.
U.S. Appl. No. 15/511,036, filed Mar. 14, 2017, titled Coke Ovens Having Monolith Component Construction.
U.S. Appl. No. 13/589,009, filed Aug. 17, 2012, titled Automatic Draft Control System for Coke Plants.
U.S. Appl. No. 15/139,568, filed Apr. 27, 2016, titled Automatic Draft Control System for Coke Plants.

(56) References Cited

OTHER PUBLICATIONS

U.S. Appl. No. 13/588,996, now U.S. Pat. No. 9,243,186, filed Aug. 17, 2012, titled Coke Plant Including Exhaust Gas Sharing.
U.S. Appl. No. 14/959,450, filed Dec. 4, 2015, now U.S. Pat. No. 10,041,002, titled Coke Plant Including Exhaust Gas Sharing, now U.S. Pat. No. 10,041,002.
U.S. Appl. No. 16/047,198, filed Jul. 27, 2018, titled Coke Plant Including Exhaust Gas Sharing.
U.S. Appl. No. 13/589,004, now U.S. Pat. No. 9,249,357, filed Aug. 17, 2012, titled Method and Apparatus for Volatile Matter Sharing in Stamp-Charged Coke Ovens.
U.S. Appl. No. 13/730,673, filed Dec. 28, 2012, titled Exhaust Flow Modifier, Duct Intersection Incorporating the Same, and Methods Therefor.
U.S. Appl. No. 15/281,891, filed Sep. 30, 2016, titled Exhaust Flow Modifier, Duck Intersection Incorporating the Same, and Methods Therefor.
U.S. Appl. No. 13/598,394, now U.S. Pat. No. 9,169,439, filed Aug. 29, 2012, titled Method and Apparatus for Testing Coal Coking Properties.
U.S. Appl. No. 14/865,581, filed Sep. 25, 2015, now U.S. Pat. No. 10,053,627, titled Method and Apparatus for Testing Coal Coking Properties, now U.S. Pat. No. 10,053,627.
U.S. Appl. No. 14/839,384, filed Aug. 28, 2015, titled Coke Oven Charging System.
U.S. Appl. No. 15/443,246, now U.S. Pat. No. 9,976,089, filed Feb. 27, 2017, titled Coke Oven Charging System.
U.S. Appl. No. 14/587,670, filed Dec. 31, 2014, titled Methods for Decarbonizing Coking Ovens, and Associated Systems and Devices.
U.S. Appl. No. 14/984,489, filed Dec. 30, 2015, titled Multi-Modal Beds of Coking Material.
U.S. Appl. No. 14/983,837, filed Dec. 30, 2015, titled Multi-Modal Beds of Coking Material.
U.S. Appl. No. 14/986,281, filed Dec. 31, 2015, titled Multi-Modal Beds of Coking Material.
U.S. Appl. No. 14/987,625, filed Jan. 4, 2016, titled Integrated Coke Plant Automation and Optimization Using Advanced Control and Optimization Techniques.
U.S. Appl. No. 14/839,493, filed Aug. 28, 2015, now U.S. Pat. No. 10,233,392, titled Method and System for Optimizing Coke Plant Operation and Output.
U.S. Appl. No. 16/251,352, filed Jan. 18, 2019, titled Method and System for Optimizing Coke Plant Operation and Output.
U.S. Appl. No. 14/839,551, filed Aug. 28, 2015, now U.S. Pat. No. 10,308,876, titled Burn Profiles for Coke Operations.
U.S. Appl. No. 16/428,014, filed May 31, 2019, titled Improved Burn Profiles for Coke Operations.
U.S. Appl. No. 14/839,588, filed Aug. 28, 2015, now U.S. Pat. No. 9,708,542, titled Method and System for Optimizing Coke Plant Operation and Output.
U.S. Appl. No. 15/392,942, filed Dec. 28, 2016, titled Method and System for Dynamically Charging a Coke Oven.
U.S. Appl. No. 15/614,525, filed Jun. 5, 2017, titled Methods and Systems for Automatically Generating a Remedial Action in an Industrial Facility.
U.S. Appl. No. 15/987,860, filed May 23, 2018, titled System and Method for Repairing a Coke Oven.
U.S. Appl. No. 16/251,352, filed Jan. 18, 2019, Quanci et al.
U.S. Appl. No. 16/428,014, filed May 31, 2019, Quanci et al.
Chinese Office Action in Chinese Application No. 2015800387532.2; dated Mar. 28, 2019; 15 pages.
Chinese Office Action in Chinese Application No. 201580051361.1; dated May 31, 2019; 23 pages.
Examination Report for European Application No. 15842460.6; dated Apr. 4, 2019; 8 pages.
India First Examination Report in Application No. 512/KOLNP/2015; dated Jun. 24, 2019; 8 pages.
India First Examination Report in Application No. 201637044911; dated Aug. 8, 2019; 9 pages.
Russian Office Action for Russian Application No. 2017112974/05; dated Feb. 21, 2019; 14 pages.
Knoerzer et al. "Jewell-Thompson Non-Recovery Cokemaking", Steel Times, Fuel & Metallurgical Journals Ltd. London, GB, vol. 221, No. 4, Apr. 1, 1993, pp. 172-173,184.
Brazilian Preliminary Examination Report for Brazilian Application No. BR112016030880-8; dated Aug. 26, 2019; 7 pages.
India First Examination Report in Application No. 201737008983; dated Sep. 17, 2019; 8 pages.
Japanese Notice of Rejection for Japanese Application No. 2017-514488; dated Aug. 6, 2019, 12 pages.

* cited by examiner

HORIZONTAL HEAT RECOVERY COKE OVENS HAVING MONOLITH CROWNS

CROSS-REFERENCE TO RELATED APPLICATIONS

This application claims the benefit of priority to U.S. Provisional Patent Application No. 62/019,385 filed Jun. 30, 2014, the disclosure of which is incorporated herein by reference in its entirety.

TECHNICAL FIELD

The present technology is generally directed to use of precast monolith geometric shapes in horizontal heat recovery coke ovens, non-heat recovery coke ovens, and beehive coke ovens, for example, use of a monolith crown in a horizontal coke oven.

BACKGROUND

Coke is a solid carbon fuel and carbon source used to melt and reduce iron ore in the production of steel. In one process, known as the "Thompson Coking Process," coke is produced by batch feeding pulverized coal to an oven that is sealed and heated to very high temperatures for 24 to 48 hours under closely-controlled atmospheric conditions. Coking ovens have been used for many years to convert coal into metallurgical coke. During the coking process, finely crushed coal is heated under controlled temperature conditions to devolatilize the coal and form a fused mass of coke having a predetermined porosity and strength. Because the production of coke is a batch process, multiple coke ovens are operated simultaneously.

The melting and fusion process undergone by the coal particles during the heating process is an important part of coking. The degree of melting and degree of assimilation of the coal particles into the molten mass determine the characteristics of the coke produced. In order to produce the strongest coke from a particular coal or coal blend, there is an optimum ratio of reactive to inert entities in the coal. The porosity and strength of the coke are important for the ore refining process and are determined by the coal source and/or method of coking.

Coal particles or a blend of coal particles are charged into hot ovens, and the coal is heated in the ovens in order to remove volatile matter ("VM") from the resulting coke. The coking process is highly dependent on the oven design, the type of coal, and the conversion temperature used. Typically, ovens are adjusted during the coking process so that each charge of coal is coked out in approximately the same amount of time. Once the coal is "coked out" or fully coked, the coke is removed from the oven and quenched with water to cool it below its ignition temperature. Alternatively, the coke is dry quenched with an inert gas. The quenching operation must also be carefully controlled so that the coke does not absorb too much moisture. Once it is quenched, the coke is screened and loaded into rail cars or trucks for shipment.

Because coal is fed into hot ovens, much of the coal feeding process is automated. In slot-type or vertical ovens, the coal is typically charged through slots or openings in the top of the ovens. Such ovens tend to be tall and narrow. Horizontal non-recovery or heat recovery type coking ovens are also used to produce coke. In the non-recovery or heat recovery type coking ovens, conveyors are used to convey the coal particles horizontally into the ovens to provide an elongate bed of coal.

As the source of coal suitable for forming metallurgical coal ("coking coal") has decreased, attempts have been made to blend weak or lower quality coals ("non-coking coal") with coking coals to provide a suitable coal charge for the ovens. One way to combine non-coking and coking coals is to use compacted or stamp-charged coal. The coal may be compacted before or after it is in the oven. In some embodiments, a mixture of non-coking and coking coals is compacted to greater than 50 pounds per cubic foot in order to use non-coking coal in the coke making process. As the percentage of non-coking coal in the coal mixture is increased, higher levels of coal compaction are required (e.g., up to about 65 to 75 pounds per cubic foot). Commercially, coal is typically compacted to about 1.15 to 1.2 specific gravity (sg) or about 70-75 pounds per cubic foot.

Horizontal Heat Recovery ("HHR") ovens have a unique environmental advantage over chemical byproduct ovens based upon the relative operating atmospheric pressure conditions inside HHR ovens. HHR ovens operate under negative pressure, whereas chemical byproduct ovens operate at a slightly positive atmospheric pressure. Both oven types are typically constructed of refractory bricks and other materials in which creating a substantially airtight environment can be a challenge because small cracks can form in these structures during day-to-day operation. Chemical byproduct ovens are kept at a positive pressure to avoid oxidizing recoverable products and overheating the ovens. Conversely, HHR ovens are kept at a negative pressure, drawing in air from outside the oven to oxidize the coal's VM and to release the heat of combustion within the oven. It is important to minimize the loss of volatile gases to the environment, so the combination of positive atmospheric conditions and small openings or cracks in chemical byproduct ovens allow raw coke oven gas ("COG") and hazardous pollutants to leak into the atmosphere. Conversely, the negative atmospheric conditions and small openings or cracks in the HHR ovens or locations elsewhere in the coke plant simply allow additional air to be drawn into the oven or other locations in the coke plant so that the negative atmospheric conditions resist the loss of COG to the atmosphere.

HHR ovens have traditionally been unable to turn down their operation (e.g., their coke production) significantly below their designed capacity without potentially damaging the ovens. This restraint is linked to temperature limitations in the ovens. More specifically, traditional HHR ovens are at least partially made of silica brick. When a silica oven is built, burnable spacers are placed between the bricks in the oven crown to allow for brick expansion. Once the oven is heated, the spacers burn away and the bricks expand into adjacency. Once HHR silica brick ovens are heated, they are never allowed to drop below the silica brick thermally-volume-stable temperature, the temperature above which silica is generally volume-stable (i.e., does not expand or contract). If the bricks drop below this temperature, the bricks start to contract. Since the spacers have burned out, a traditional crown can contract up to several inches upon cooling. This is potentially enough movement for the crown bricks to start to shift and potentially collapse. Therefore, enough heat must be maintained in the ovens to keep the bricks above the thermally-volume-stable temperature. This is the reason why it has been stated that a HHR oven can never be turned off Because the ovens cannot be significantly turned down, during periods of low steel and coke demand, coke production must be sustained. Further, it can be difficult to perform maintenance on heated HHR ovens. Other portions of the coke oven system can suffer from similar thermal and/or structural limitations. For example, the crown of a sole flue running under the oven floor can collapse or otherwise suffer from heaving of the oven floor, ground settling, thermal or structural cycling, or other fatigue. These stresses can cause bricks in the sole flue to shift and drop out.

SUMMARY

This Summary is provided to introduce a selection of concepts in a simplified form that are further described below in the Detailed Description. This Summary, and the foregoing Background, is not intended to identify key aspects or essential aspects of the claimed subject matter. Moreover, this Summary is not intended for use as an aid in determining the scope of the claimed subject matter.

One embodiment of the present technology relates to a coke oven chamber including an oven floor, a forward end portion and a rearward end portion opposite the forward end portion. First and second sidewalls extend vertically upward from the floor between a front wall and a back wall. A crown is positioned above the floor and spans from the first sidewall to the second sidewall. A sole flue, formed at least partially from a thermally-volume-stable material and having a plurality of adjacent runs between the first sidewall and the second sidewall, is positioned beneath the oven floor.

In some embodiments, the sole flue includes at least one sole flue wall formed from a plurality of sole flue wall segments. The sole flue wall segments are coupled with one another using one or more interlocking, cooperating features. In various embodiments, one or more blocking wall sections coupled with, and extending generally transverse from, at least one sole flue wall. In another embodiment, at least one generally J-shaped arch section spans a gap between an end portion of at least one sole flue wall and a sole flue end wall. Still other embodiments of the sole flue include at least one sole flue corner section having a rearward face that is shaped to engage a corner area of at least one of the plurality of adjacent runs and an opposing, curvilinear or concave forward face. In such embodiments, the sole flue corner section may be positioned to direct fluid flow past the corner area.

In various embodiments of the present technology, the coke oven chamber includes downcommer channels that extend through at least one of the first sidewall and second sidewall. In such embodiments, the downcommer channels are placed in open fluid communication with the oven chamber and the sole flue. Aspects of the present technology provide the downcommer channels with various geometric shapes cross-sections. In some embodiments, the downcommer channels are formed from a plurality of channel blocks having channels that penetrate the channel blocks. In some embodiments, one or more downcommer covers are coupled with an opening to at least one downcommer channel. Some such embodiments, the downcommer cover includes a plug that is shaped to be received within an access opening that penetrates the downcover cover.

These and other aspects of the present system and method will be apparent after consideration of the Detailed Description and Figures herein. It is to be understood, however, that the scope of the invention shall be determined by the claims as issued and not by whether given subject matter addresses any or all issues noted in the Background or includes any features or aspects recited in this Summary.

DETAILED DESCRIPTION

The present technology is generally directed to horizontal heat recovery coke ovens having monolith crowns. In some embodiments, a HHR coke oven includes a monolith crown that spans the width of the oven between opposing oven sidewalls. The monolith expands upon heating and contracts upon cooling as a single structure. In further embodiments, the crown comprises a thermally-volume-stable material. In various embodiments, the monolith and thermally-volume-stable features can be used in combination or alone. These designs can allow the oven to be turned down below traditionally-feasible temperatures while maintaining the structural integrity of the crown.

Specific details of several embodiments of the technology are described below with reference to FIGS. 1A-7. Other details describing well-known structures and systems often associated with coke ovens have not been set forth in the following disclosure to avoid unnecessarily obscuring the description of the various embodiments of the technology. Many of the details, dimensions, angles, and other features shown in the Figures are merely illustrative of particular embodiments of the technology. Accordingly, other embodiments can have other details, dimensions, angles, and features without departing from the spirit or scope of the present technology. A person of ordinary skill in the art, therefore, will accordingly understand that the technology may have other embodiments with additional elements, or the technology may have other embodiments without several of the features shown and described below with reference to FIGS. 1A-7.

Figure 1A:
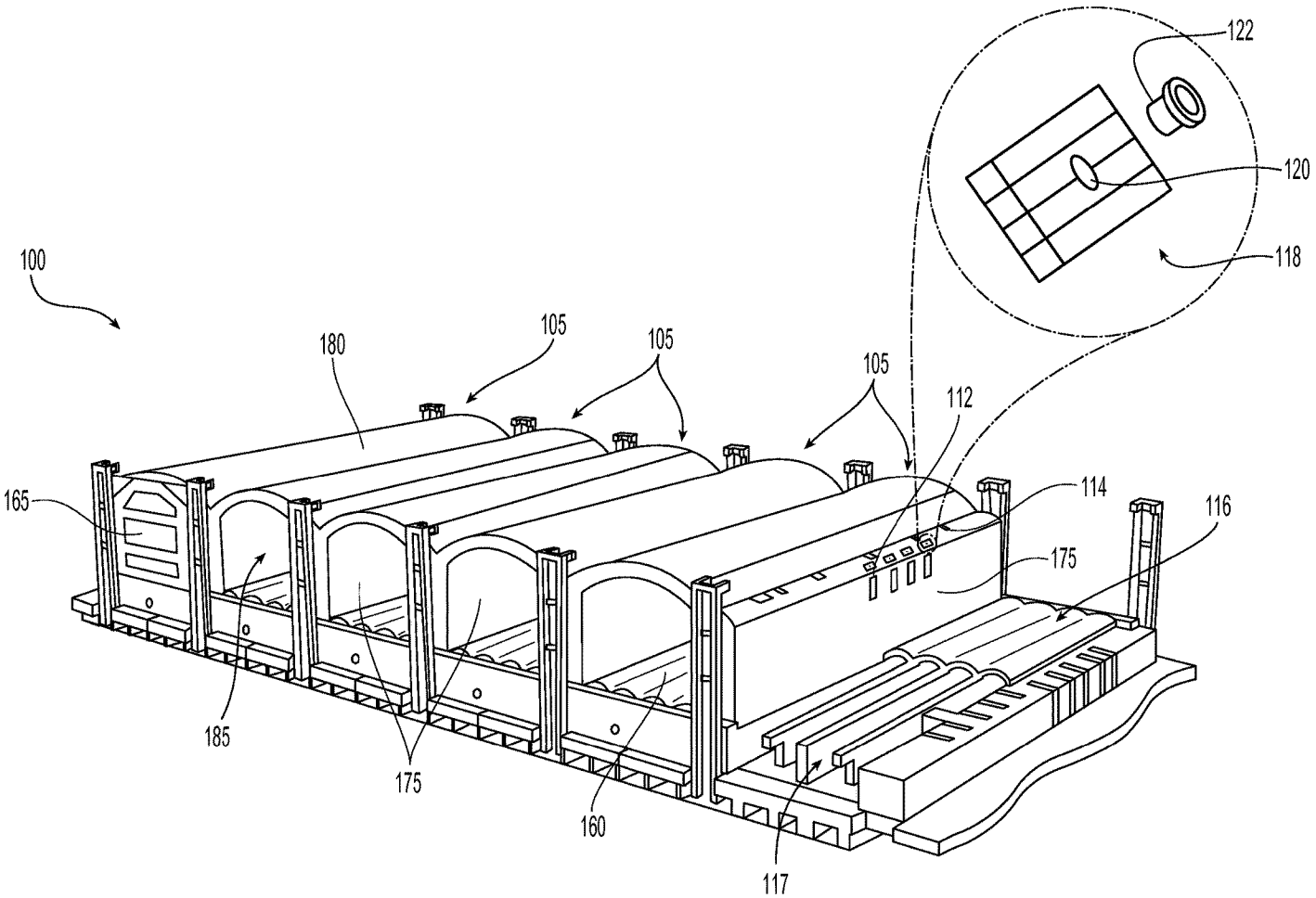
FIG. 1A is an isometric, partial cut-away view of a portion of a horizontal heat recovery coke plant configured in accordance with embodiments of the present technology.

FIG. 1A is an isometric, partial cut-away view of a portion of a horizontal heat recovery ("HHR") coke plant 100 configured in accordance with embodiments of the technology. The plant 100 includes a plurality of coke ovens 105. Each oven 105 can include an open cavity defined by a floor 160, a front door 165 forming substantially the entirety of one side of the oven, a rear door (not shown) opposite the front door 165 forming substantially the entirety of the side of the oven opposite the front door, two sidewalls 175 extending upwardly from the oven floor 160 intermediate the front door 165 and rear door, and a crown 180 that forms the top surface of the open cavity of an oven chamber 185. A first end of the crown 180 can rest on a first sidewall 175 while a second end of the crown 180 can rest on an opposing sidewall 175 as shown. Adjacent ovens 105 can share a common sidewall 175.

Figure 1B:
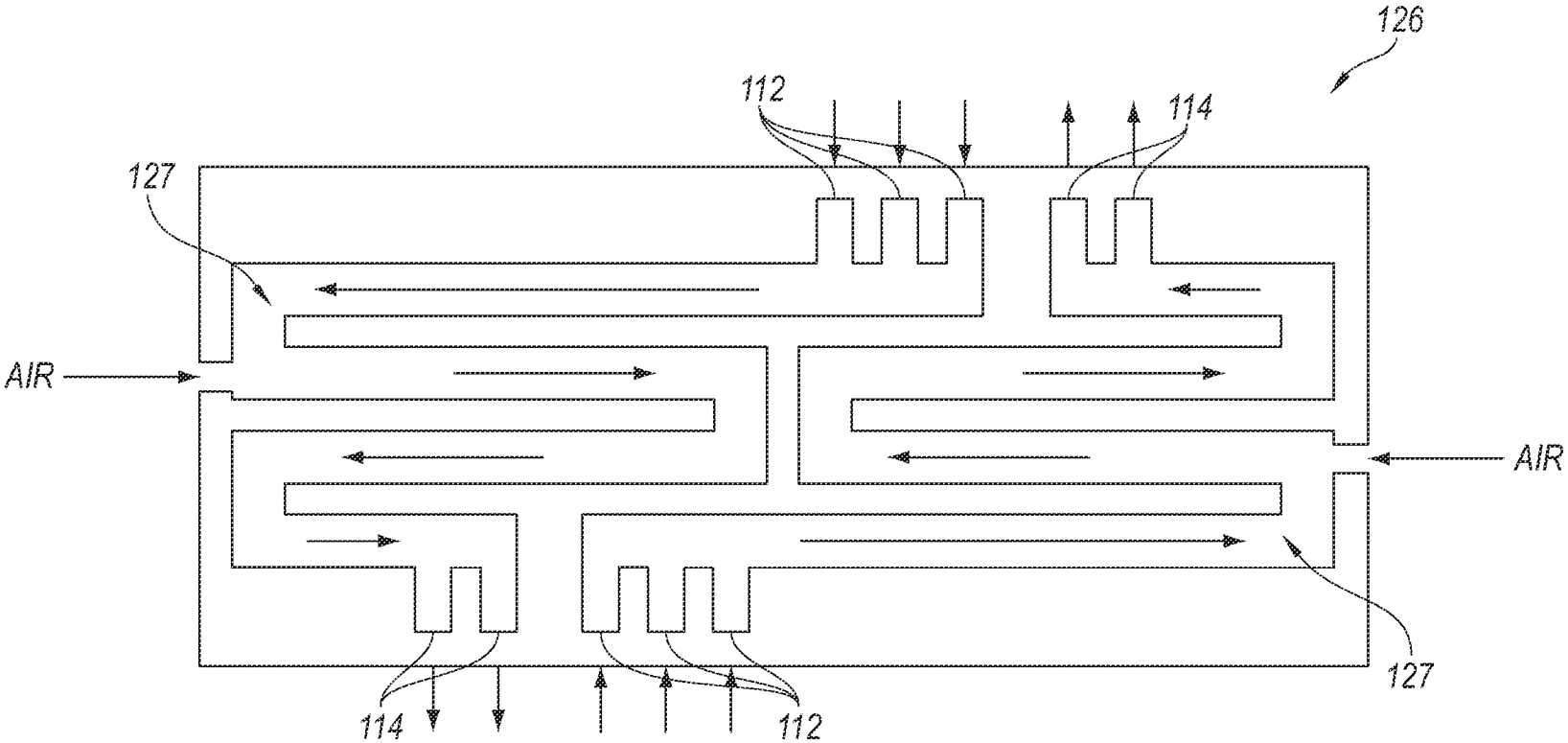
FIG. 1B is a top view of a sole flue portion of a horizontal heat recovery coke oven configured in accordance with embodiments of the technology.

In operation, volatile gases emitted from the coal positioned inside the oven chamber 185 collect in the crown 180 and are drawn downstream in the overall system into downcommer channels 112 formed in one or both sidewalls 175. The downcommer channels 112 fluidly connect the oven chamber 185 with a sole flue 116 positioned beneath the oven floor 160. The sole flue 116 includes a plurality of side-by-side runs 117 that form a circuitous path beneath the oven floor 160. While the runs 117 in FIG. 1A are shown to be substantially parallel to a longitudinal axis of the oven 105 (i.e., parallel to the sidewalls 175), in further embodiments, the sole flue 116 can be configured such that at least some segments of the runs 117 are generally perpendicular to the longitudinal axis of the oven 105 (i.e., perpendicular to the sidewalls 175). This arrangement is illustrated in FIG. 1B and is discussed in further detail below. Volatile gases emitted from the coal can be combusted in the sole flue 116, thereby generating heat to support the reduction of coal into coke. The downcommer channels 112 are fluidly connected to chimneys or uptake channels 114 formed in one or both sidewalls 175.

From time to time, the downcommer channels 112 may require inspection or service to ensure that the oven chamber 185 remains in open fluid communication with the sole flue 116 positioned beneath the oven floor 160. Accordingly, in various embodiments, downcommer covers 118 are positioned over openings in the upper end portions of the individual downcommer channels 112. In some embodiments, the downcommer covers 118 may be provided as a single, plate structure. In other embodiments, such as depicted in FIG. 1A, the downcommer covers 118 may be formed from a plurality of separate cover members that are positioned closely adjacent, or secured with, one another. Certain embodiments of the downcommer covers 118 include one or more inspection openings 120 that penetrate central portions of the downcommer cover 118. While depicted as being round, it is contemplated that the inspection openings 120 may be formed to be nearly any curvilinear, or polygonal shape, desired for the particular application. Plugs 122 are provided to have shapes that approximate those of the inspection openings 120. Accordingly, the plugs 122 may be removed for visual inspection or repair of the downcommer channels 112 and returned in order to limit the unintentional escape of volatile gases. In additional embodiments a liner may extend the full length of the channel to interface with the inspection opening. In alternative embodiments, the liner may extend only a portion of the channel length.

Coke is produced in the ovens 105 by first loading coal into the oven chamber 185, heating the coal in an oxygen-depleted environment, driving off the volatile fraction of coal, and then oxidizing the VM within the oven 105 to capture and utilize the heat given off. The coal volatiles are oxidized within the ovens 105 over an extended coking cycle and release heat to regeneratively drive the carbonization of the coal to coke. The coking cycle begins when the front door 165 is opened and coal is charged onto the oven floor 160. The coal on the oven floor 160 is known as the coal bed. Heat from the oven (due to the previous coking cycle) starts the carbonization cycle. Roughly half of the total heat transfer to the coal bed is radiated down onto the top surface of the coal bed from the luminous flame of the coal bed and the radiant oven crown 180. The remaining half of the heat is transferred to the coal bed by conduction from the oven floor 160, which is convectively heated from the volatilization of gases in the sole flue 116. In this way, a carbonization process "wave" of plastic flow of the coal particles and formation of high strength cohesive coke proceeds from both the top and bottom boundaries of the coal bed.

Typically, each oven 105 is operated at negative pressure so air is drawn into the oven during the reduction process due to the pressure differential between the oven 105 and the atmosphere. Primary air for combustion is added to the oven chamber 185 to partially oxidize the coal volatiles, but the amount of this primary air is controlled so that only a portion of the volatiles released from the coal are combusted in the oven chamber 185, thereby releasing only a fraction of their enthalpy of combustion within the oven chamber 185. The primary air is introduced into the oven chamber 185 above the coal bed. The partially combusted gases pass from the oven chamber 185 through the downcommer channels 112 into the sole flue 116 where secondary air is added to the partially combusted gases. As the secondary air is introduced, the partially combusted gases are more fully combusted in the sole flue 116, thereby extracting the remaining enthalpy of combustion, which is conveyed through the oven floor 160 to add heat to the oven chamber 185. The fully or nearly fully combusted exhaust gases exit the sole flue 116 through the uptake channels 114. At the end of the coking cycle, the coal has coked out and has carbonized to produce coke. The coke can be removed from the oven 105 through the rear door utilizing a mechanical extraction system. Finally, the coke is quenched (e.g., wet or dry quenched) and sized before delivery to a user.

Figure 3:
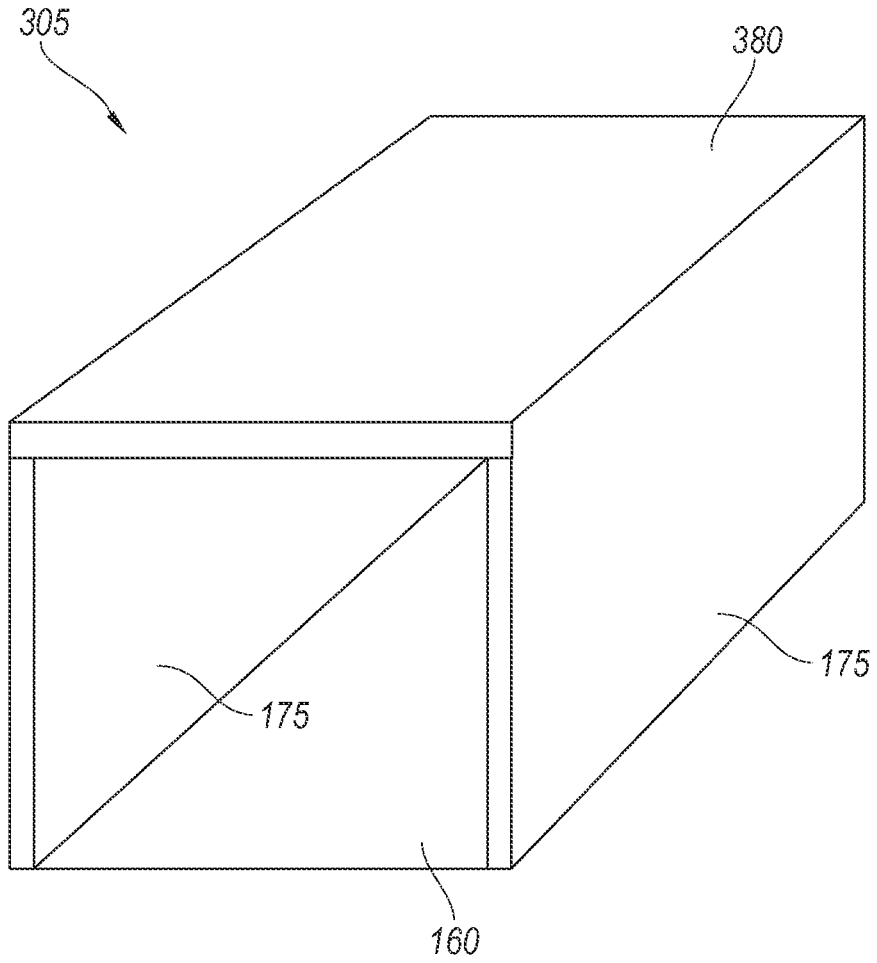
FIG. 3 is an isometric view of a coke oven having a monolith crown configured in accordance with further embodiments of the technology.
Figure 4A:
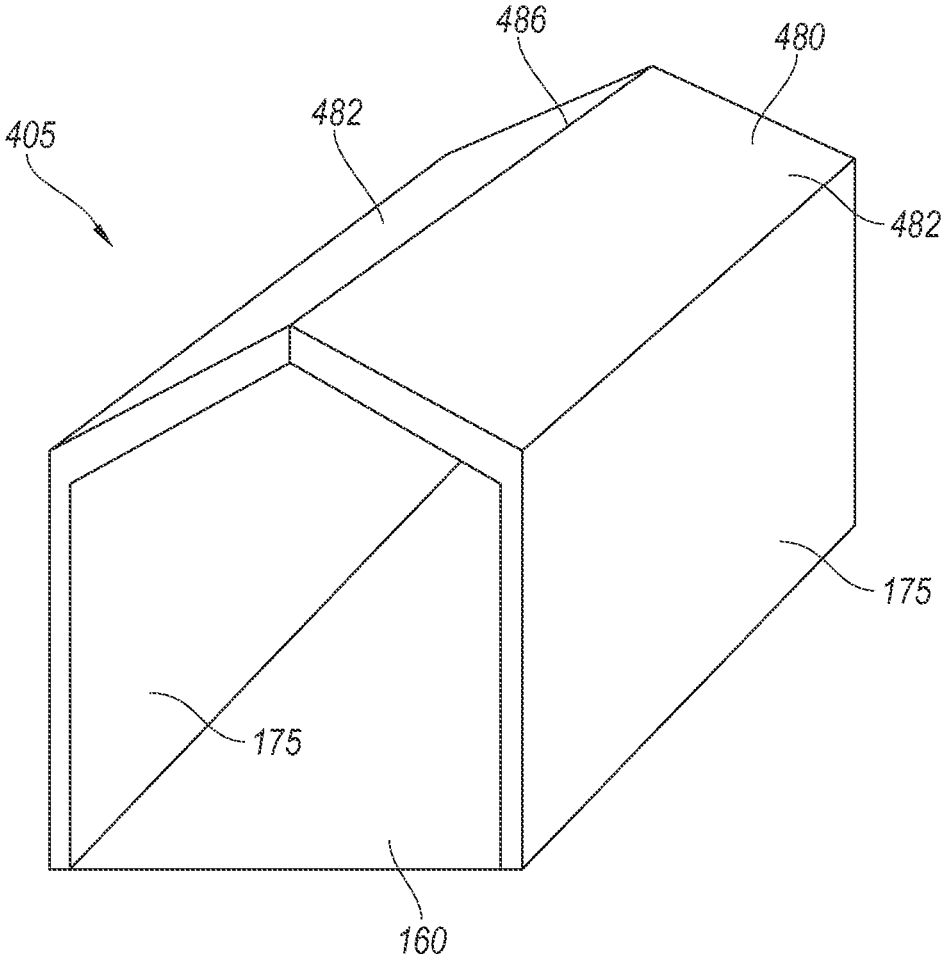
FIG. 4A is an isometric view of a coke oven having a monolith crown configured in accordance with still further embodiments of the technology.

As will be discussed in further detail below with reference to FIGS. 2A-4B, in several embodiments, the crown 180 comprises a monolith structure configured to span all or a portion of the distance between the sidewalls 175. For example, the crown 180 can comprise a single segment that spans between the sidewalls 175 or can comprise two, three, four, or more segments that meet between the sidewalls 175 and in combination span between the sidewalls 175. The monolith structure enables the crown 180 to expand upon oven heating and retract upon cooling without allowing individual bricks to contract and fall into the oven chamber 185, causing the crown 180 to collapse. The monolith crown 180 can accordingly allow the oven 105 to be shut down or turned down below traditionally feasible temperatures for a given crown material. As discussed above, some materials, like silica, become generally thermally-volume-stable above certain temperatures (i.e., around 1,200° F. for silica). Using a crown 180, a silica brick oven can be turned down below 1,200° F. Other materials, such as alumina, have no thermally-volume-stable upper limit (i.e., remain volume-unstable), and the crown 180 allows for the use of these materials without collapse from cooling contraction. In other embodiments, other materials or combinations of materials can be used for the crown, with different materials having different associated thermally-volume-stable temperatures. Further, the monolith crown 180 can be quickly installed, as the whole arch can be lifted and placed as a single structure. Further, by using monolith segments instead of numerous individual bricks, the crown 180 can be built in shapes different from the traditional arch—such as a flat or straight-edged shape. Some of these designs are shown in FIGS. 3 and 4A. In various embodiments, the monolith crown 180 can be pre-formed or formed on site. The crown 180 can have various widths (i.e., from sidewall-to-sidewall) in different embodiments. In some embodiments, the crown 180 width is about 3 feet or greater, while in particular embodiments, the width is 12-15 feet.

In some embodiments, the crown 180 is at least partially made of a thermally-volume-stable material such that upon heating or cooling the oven chamber 185, the crown 180 does not adjust in position. As with a monolith design, a crown 180 made of a thermally-volume-stable material allows the oven 105 to be shut down or turned down without individual bricks in the crown 180 contracting and collapsing into the oven chamber 185. While the term "thermally-volume-stable material" is used herein, this term can refer to materials that are zero-expansion, zero-contraction, near-zero-expansion, and/or near-zero-contraction, or a combination of these characteristics, upon heating and/or cooling. In some embodiments, the thermally-volume-stable materials can be pre-cast or pre-fabricated into designed shapes, including as individual bricks or monolith segments. Further, in some embodiments, the thermally-volume-stable materials can be repeatedly heated and cooled without affecting the expandability characteristics of the material, while in other embodiments the material can be heated and/or cooled only once before undergoing a phase or material change that affects subsequent expandability characteristics. In a particular embodiment, the thermally-volume-stable material is a fused silica material, zirconia, refractory material, or a ceramic material. In further embodiments, other portions of the oven 105 additionally or alternately can be formed of thermally-volume-stable materials. For example, in some embodiments, the lintel for the door 165 comprises such a material. When using thermally-volume-stable materials, traditional-sized bricks or a monolith structure can be used as the crown 180.

In some embodiments, the monolith or thermally-volume-stable designs can be used at other points in the plant 100, such as over the sole flue 116, as part of the oven floor 160 or sidewalls 175, or other portions of the oven 105. In any of these locations, the monolith or thermally-volume-stable embodiments can be used as an individual structure or as a combination of sections. For example, a crown 180 or oven floor 160 can comprise multiple monolith segments and/or multiple segments made of thermally-volume-stable material. In another embodiment, as shown in FIG. 1A, a monolith over the sole flue 116 comprises a plurality of side-by-side arches, each arch covering a run 117 of the sole flue 116. Since the arches comprise a single structure, they can expand and contract as a single unit. In further embodiments (as will be discussed in further detail below), the crown of the sole flue can comprise other shapes, such as a flat top. In still further embodiments, the sole flue crown comprises individual segments (e.g., individual arches or flat portions) that each span only one run 117 of the sole flue 116.

FIG. 1B is a top view of a sole flue 126 of a horizontal heat recovery coke oven configured in accordance with embodiments of the technology. The sole flue 126 has several features generally similar to the sole flue 116 described above with reference to FIG. 1A. For example, the sole flue includes a serpentine or labyrinth pattern of runs 127 configured for communication with a coke oven (e.g., the coke oven 105 of FIG. 1A) via the downcommer channels 112 and uptake channels 114. Volatile gases emitted from the coal positioned inside a coke oven chamber are drawn downstream into the downcommer channels 112 and into the sole flue 126. Volatile gases emitted from the coal can be combusted in the sole flue 126, thereby generating heat to support the reduction of coal into coke. The downcommer channels 112 are fluidly connected to chimneys or uptake channels 114, which draw fully or nearly fully combusted exhaust gases from the sole flue 126.

In FIG. 1B, at least some segments of the runs 127 are generally perpendicular to the longitudinal axis of the oven 105 (i.e., perpendicular to the sidewalls 175 shown in FIG. 1A). As with the sole flue 116, shown in FIG. 1A, the sole flue 126 of FIG. 1B can include a crown portion that spans individual runs 127 or a plurality of runs 127. The sole flue crown can comprise a flat segment, a single arch, a plurality of adjacent arches, a combination of these shapes, or other shapes. Further, the sole flue crown can span and/or follow the turns or curves of the sole flue serpentine pathway of runs 127.

Figure 1C:
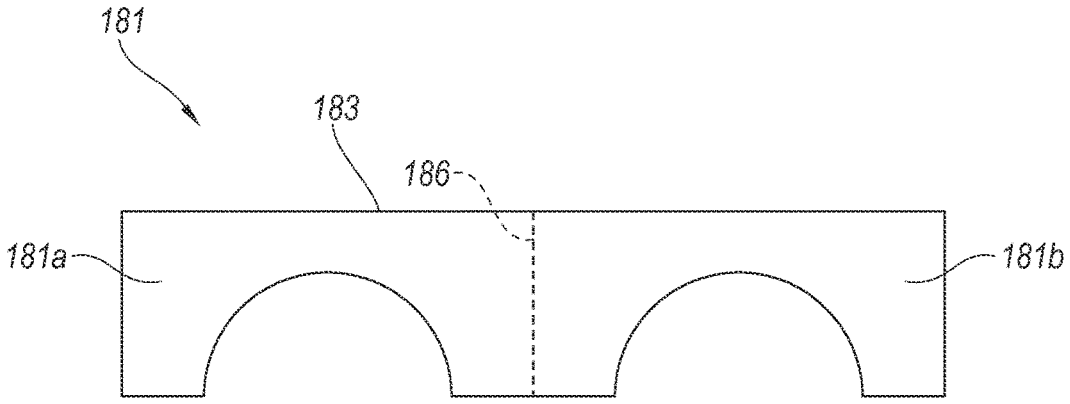
FIG. 1C is a front view of a monolith crown for use with the sole flue shown in FIG. 1B and configured in accordance with embodiments of the technology.

FIG. 1C is a front view of a monolith crown 181 for use with the sole flue 126 shown in FIG. 1B and configured in accordance with embodiments of the technology. In the illustrated embodiment, the crown 181 comprises a plurality of adjacent arched portions 181*a*, 181*b* having a flat top 183. Each portion 181*a*, 181*b* can be used as a crown for an individual run in the sole flue 126. Further, the flat top 183 can comprise a floor or subfloor for the oven chamber 185 described above with reference to FIG. 1A. In some embodiments, a layer of bricks can be placed on top of the flat top 183.

In various embodiments, the crown 181 can comprise a single monolith segment or a plurality of individual segments (e.g., the individual arched portions 181*a*, 181*b*) that are separated by an optional joint 186 shown in broken line. Accordingly, a single monolith crown 181 can cover one run or a plurality of adjacent runs in the sole flue 126. As mentioned above, in further embodiments, the crown 181 can have shapes other than an arched underside with a flat top. For example, the crown 181 can be entirely flat, entirely arched or curved, or other combinations of these characteristics. While the crown 181 has been described for use with the sole flue 126 of FIG. 1B, it could similarly be used with the sole flue 116 or coking chamber 185 shown in FIG. 1A.

Figure 2A:
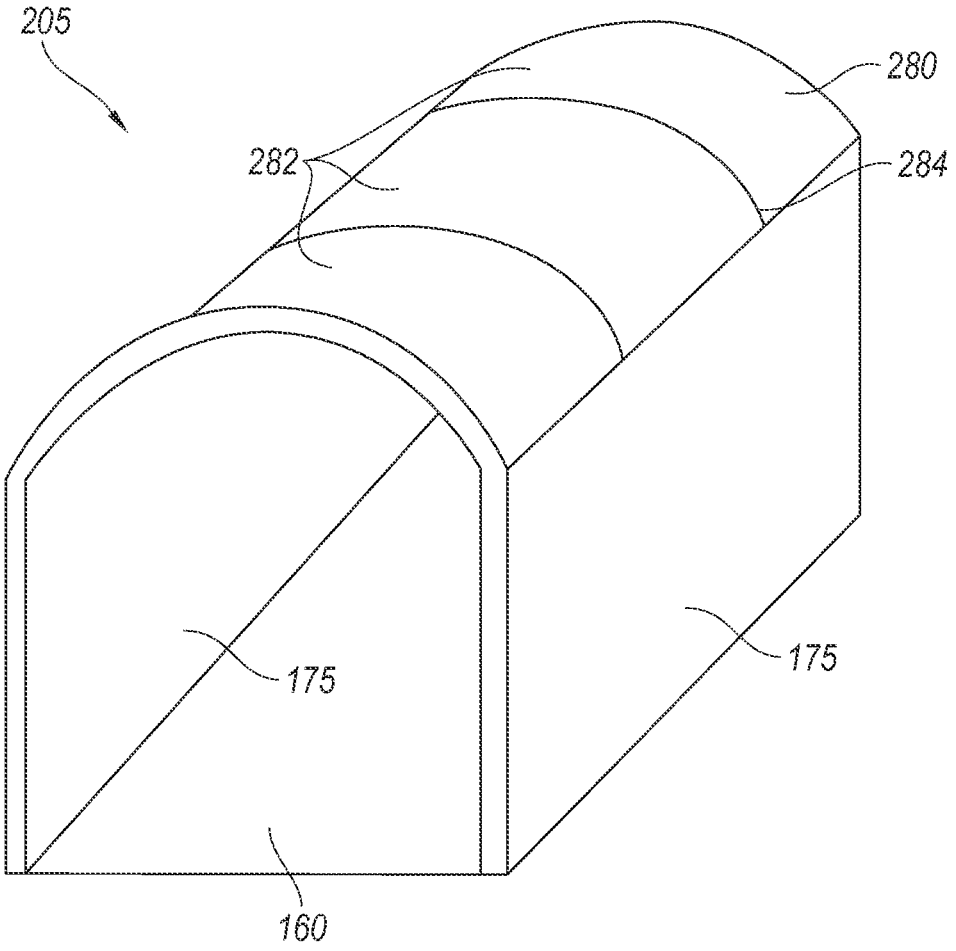
FIG. 2A is an isometric view of a coke oven having a monolith crown configured in accordance with embodiments of the technology.

FIG. 2A is an isometric view of a coke oven 205 having a monolith crown 280 configured in accordance with embodiments of the technology. The oven 205 is generally similar to the oven 105 described above with reference to FIG. 1. For example, the oven 205 includes the oven floor 160 and the opposing sidewalls 175. The crown 280 comprises a monolith structure, wherein the crown 280 extends between the sidewalls 175. In the illustrated embodiment, the crown 280 comprises a plurality of crown segments 282 generally adjacent to one another and aligned along the length of the oven 205 between the front and back of the oven 205. While three segments 282 are illustrated, in further embodiments, there can be more or fewer segments 282. In still further embodiments, the crown 280 comprises a single monolith structure extending from the front of the oven 205 to the back. In some embodiments, multiple segments 282 are used to ease construction. The individual segments can meet joints 284. In some embodiments, the joints 284 are filled with refractory material, such as refractory blanket, mortar, or other suitable material, to prevent air in-leakage and unintentional exhaust. In still further embodiments, as will be discussed with reference to FIG. 4 below, the crown 280 can comprise multiple lateral segments between the sidewalls 175 that meet or join over the oven floor 160.

Figure 2B:
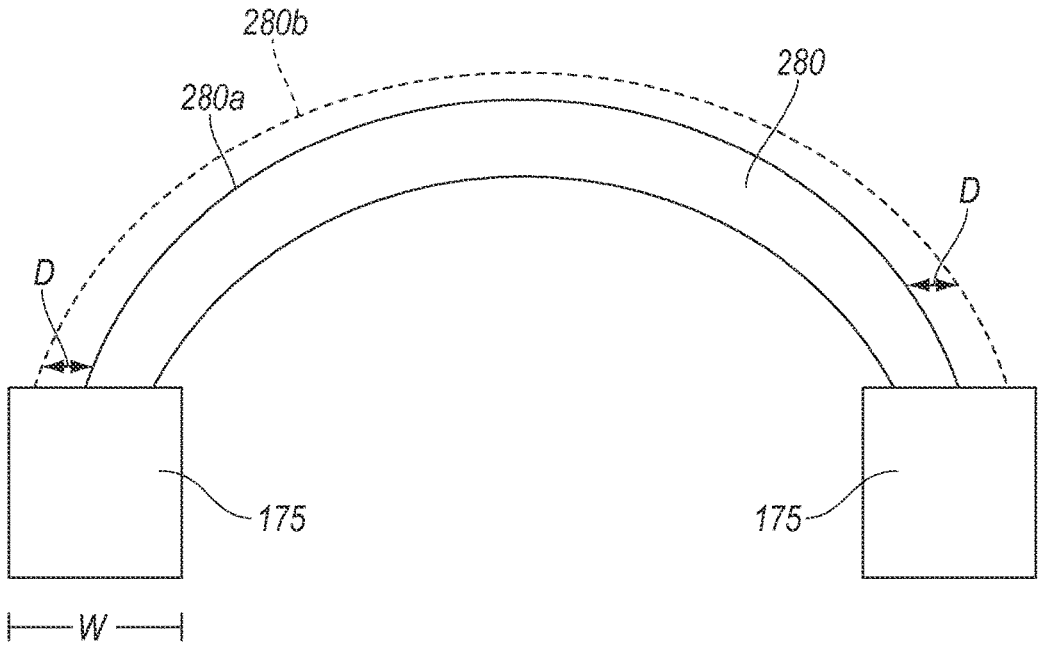
FIG. 2B is a front view of the monolith crown of FIG. 2A moving between a contracted configuration and an expanded configuration in accordance with embodiments of the technology.

FIG. 2B is a front view of the monolith crown 280 of FIG. 2A moving between a contracted configuration 280*a* and an expanded configuration 280*b* in accordance with embodiments of the technology. As discussed above, traditional crown materials expand upon oven heating and contract upon cooling. This retraction can create space between individual oven bricks and cause bricks in the crown to collapse into the oven chamber. Using a monolith, however, the crown 280 expands and contracts as a single structure.

The design of the oven 205 provides structural support for such expansion and contraction upon heating and cooling. More specifically, the sidewalls 175 that support the crown 280 can have a width W that is sufficiently greater than the width of the crown 280 to fully support the crown 280 as the crown 280 moves laterally between the contracted 280*a* and expanded 280*b* configurations. For example, the width W can be at least the width of the crown 280 plus the distance D of expansion. Therefore, when the crown 280 expands or is translated laterally outward upon heating, and contracts and translates laterally inward again upon cooling, the sidewalls 175 maintain support of the crown 280. The crown 280 can likewise expand or translate longitudinally outward upon heating, and contract and translate longitudinally inward upon cooling. The front and back walls (or door frames) of the oven 205 can accordingly be sized to accommodate this shifting.

In further embodiments, the crown 280 can rest on a crown footing other than directly on the sidewalls 175. Such a footing can be coupled to or be an independent structure of the sidewalls 175. In still further embodiments, the entire oven may be made of expanding and contracting material and can expand and contract with the crown 280, and may not require sidewalls having a width as large as the width W shown in FIG. 2B because the crown 280 stays generally aligned with the expanding sidewalls 175 upon heating and cooling. Similarly, if both the crown 280 and sidewalls 175 are made of a thermally-volume-stable material, then the sidewalls 175 can stay generally aligned with the crown 280 upon heating and cooling, and the sidewalls 175 need not be substantially wider (or even as wide) as the crown 280. In some embodiments, the sidewalls 175, front or back door frames, and/or crown 280 can be retained in place via a compression or tension system, such as a spring-load system. In a particular embodiment, the compression system can include one or more buckstays on an exterior portion of the sidewalls 175 and configured to inhibit the sidewalls 175 from outward movement. In further embodiments, such a compression system is absent.

Figure 2C:
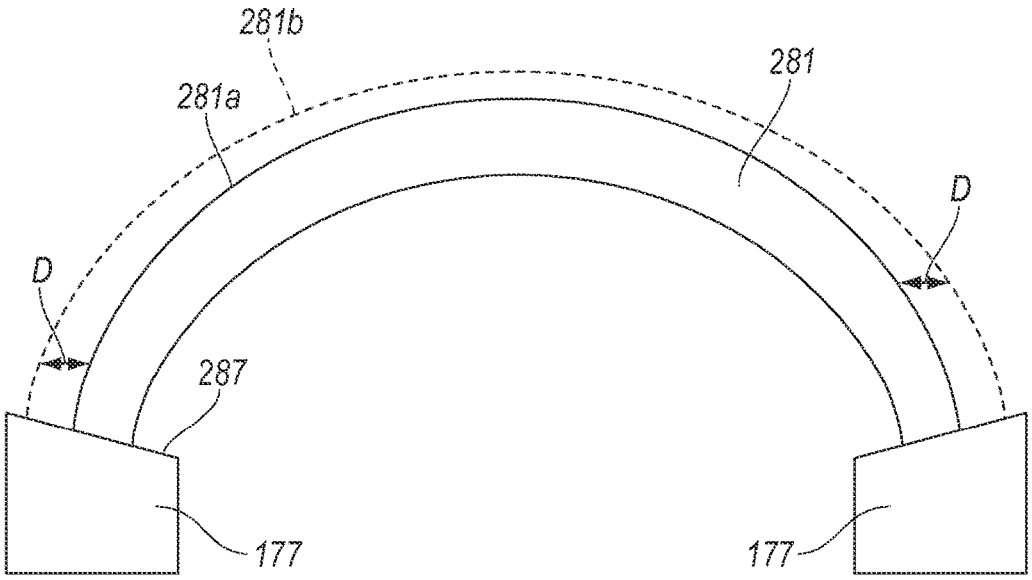
FIG. 2C is a front view of oven sidewalls for supporting a monolith crown configured in accordance with further embodiments of the technology.

FIG. 2C is a front view of oven sidewalls 177 for supporting a monolith crown 281 configured in accordance with further embodiments of the technology. The sidewalls 177 and crown 281 are generally similar to the sidewalls 175 and crown 280 shown in FIG. 2B. In the embodiment shown in FIG. 2C, however, the sidewalls 177 and crown 281 have an angled or slanted interface 287. Thus, when the crown 281 expands distance D upon heating (i.e., translates from position 281*a* to position 281*b*), the crown 281 translates along the slanted surface of the top of the sidewall 177 following the pattern of the interface 287.

Figure 2D:
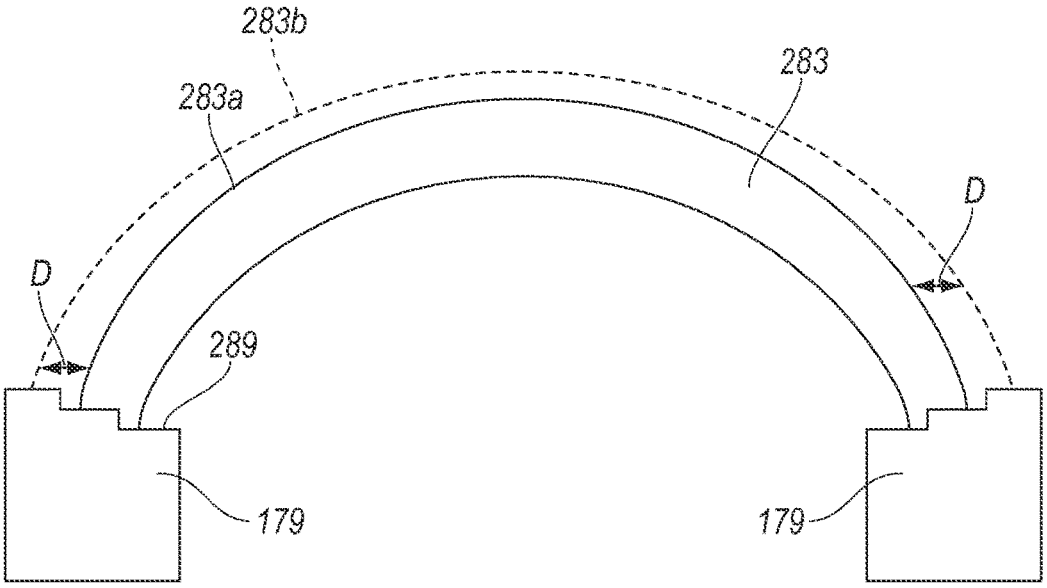
FIG. 2D is a front view of oven sidewalls for supporting a monolith crown configured in accordance with further embodiments of the technology.

In other embodiments, the crown 281 and sidewalls 177 can interface in other patterns, such as recesses, slots, overlapping portions, and/or interlocking features. For example, FIG. 2D is a front view of oven sidewalls 179 for supporting a monolith crown 283 configured in accordance with further embodiments of the technology. The sidewalls 179 and crown 283 are generally similar to the sidewalls 175 and crown 280 shown in FIG. 2B. In the embodiment shown in FIG. 2D, however, the sidewalls 179 and crown 283 have a stepped or zigzag interface 289. Thus, when the crown 283 expands distance D upon heating (i.e., translates from position 283*a* to position 283*b*), the crown 283 translates along the stepped surface of the top of the sidewall 179 following the pattern of the interface 289.

FIG. 3 is an isometric view of a coke oven 305 having a monolith crown 380 configured in accordance with further embodiments of the technology. Because the crown 380 is preformed, it can take on shapes other than the traditional arch. In the illustrated embodiment, for example, the crown 380 comprises a generally flat surface. This design can provide for minimal material costs. In other embodiments, other crown shapes can be employed to improve gas distribution in the oven 305, to minimize material costs, or for other efficiency factors.

FIG. 4A is an isometric view of a coke oven 405 having a monolith crown 480 configured in accordance with other embodiments of the technology. The crown 405 comprises a plurality (e.g., two) monolith portions 482 that meet at a joint 486 over the oven floor 160. The joint 486 can be sealed and/or insulated with any suitable refractory material if necessary. In various embodiments, the joint(s) 486 can be centered on the crown 480 or can be off-center. The monolith portions 482 can be the same size or a variety of sizes. The monolith portions 482 can be generally horizontal or angled (as shown) relative to the oven floor 160. The angle can be selected to optimize air distribution in the oven chamber. There can be more or fewer monolith portions 482 in further embodiments.

Figure 4B:
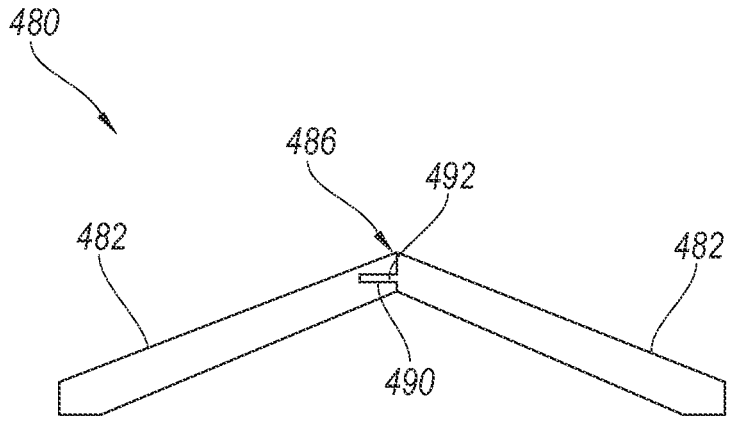
FIG. 4B is a front view of the monolith crown of FIG. 4A configured in accordance with further embodiments of the technology.

FIG. 4B is a front view of the monolith crown 480 of FIG. 4A configured in accordance with further embodiments of the technology. As shown in FIG. 4B, the monolith portions 482 can include an interfacing feature at the joint 486 to better secure the monolith portions 482 to one another. For example, in the illustrated embodiment, the joint 486 comprises a pin 492 on one monolith portion 482 configured to slide into and interface with a slot 490 on the adjacent monolith portion 482. In further embodiments, the joint 486 can comprise other recesses, slots, overlapping features, interlocking features, or other types of interfaces. In still further embodiments, mortar is used to seal or fill the joint 486.

While the illustrated interfacing feature is along a joint 486 that is generally parallel to the sidewalls 175, in further embodiments, the interfacing feature can be used at a joint that is generally perpendicular to the sidewalls 175. For example, any of the interfacing features described above could be used at the joints 284 between the crown segments 282 of FIG. 2A. Thus, the interfacing features can be used at any joint in the crown 480, regardless of whether monolith portions are orientated side-to-side or front-to-back over the oven floor. In accordance with aspects of the disclosure, the crown or precast section may be an oven crown, an upcommer arch, a downcommer arch, a J-piece, a single sole flue arch or multiple sole flue arches, a downcommer cleanout, curvilinear corner sections, and/or combined portions of any of the above sections. In some embodiments, the crown is formed at least in part with a thermally-volume-stable material. In further embodiments, the crown is formed as a monolith (or several monolith segments) spanning between supports such as oven sidewalls.

Figure 5A:
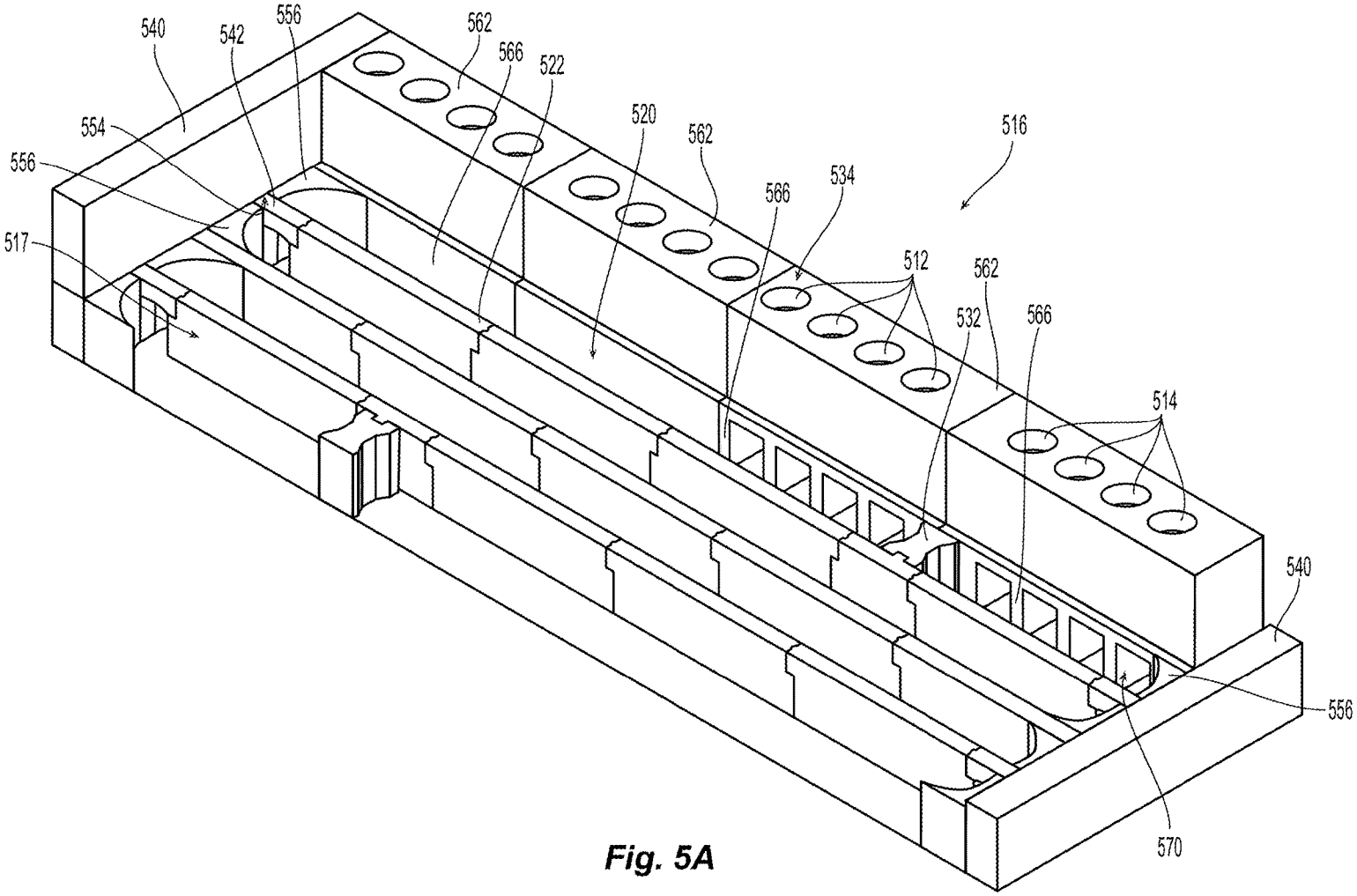
FIG. 5A is an isometric, partial cut-away view of a sole flue portion of a horizontal heat recovery coke oven configured in accordance with embodiments of the technology.

FIG. 5A depicts a partial, cut-away view of a sole flue 516 portion of a horizontal heat recovery coke oven configured in accordance with embodiments of the technology. The downcommer channels 112 fluidly connect the oven chamber 185 with the sole flue 516. The sole flue 516 includes a plurality of side-by-side runs 517 beneath the oven floor. As discussed with respect to the oven 105, the runs 517 in FIG. 5A are shown to be substantially parallel to a longitudinal axis of the oven. However, in other embodiments, the sole flue 516 can be configured such that at least some segments of the runs 517 are generally perpendicular to the longitudinal axis of the oven.

Figure 5B:
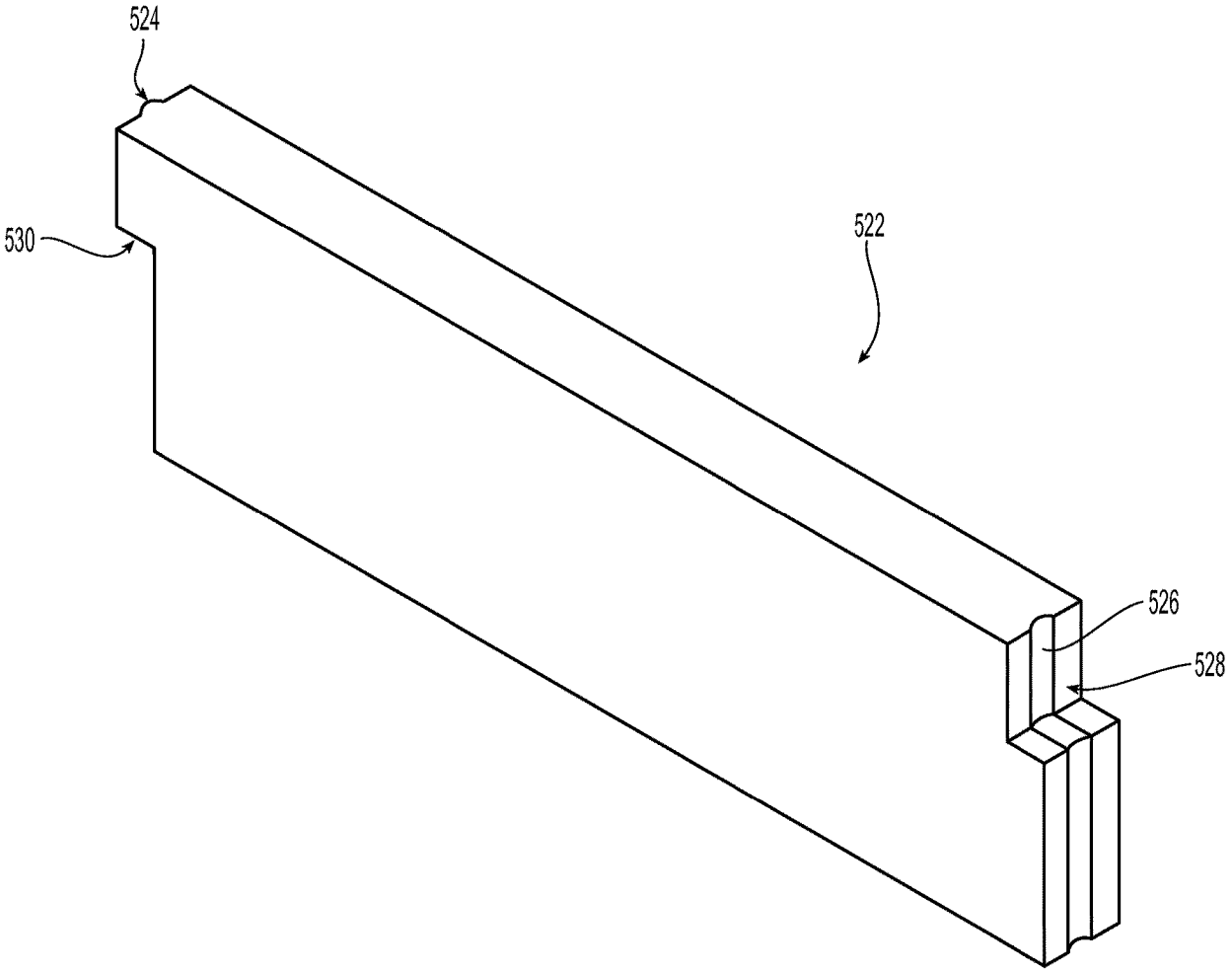
FIG. 5B is an isometric view of a section of a sole flue wall for use with the sole flue shown in FIG. 5A and configured in accordance with embodiments of the technology.
Figure 5D:
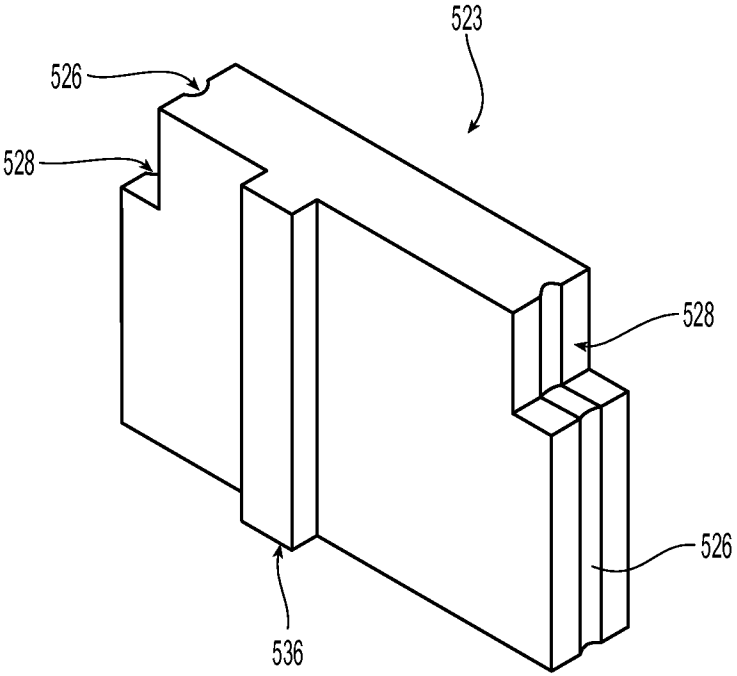
FIG. 5D is an isometric view of another section of sole flue wall for use with the sole flue shown in FIG. 5A and configured in accordance with embodiments of the technology.
Figure 5C:
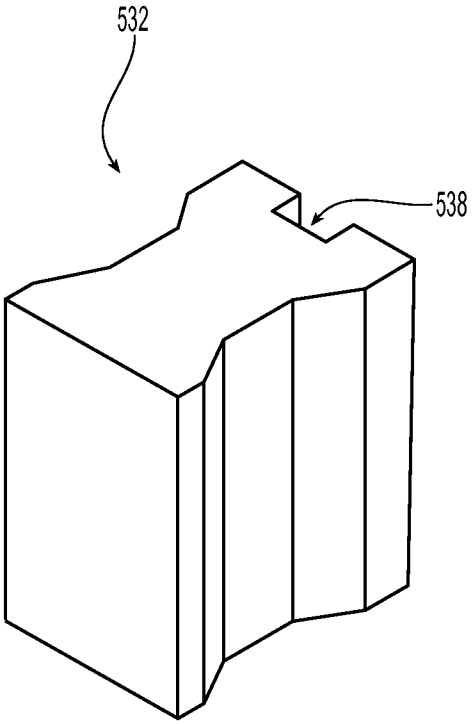
FIG. 5C is an isometric view of a blocking wall section for use with the sole flue shown in FIG. 5A and configured in accordance with embodiments of the technology.

The runs 517 are separated by sole flue walls 520. While it is contemplated that the sole flue walls 520 could be formed in a one-piece construction, such as a single casting or cast-in-place unit. However, in other embodiments, a plurality of sole flue wall segments 522 couple with one another to define the individual sole flue walls 520. With reference to FIGS. 5B and 5D, the individual sole flue wall segments 522 may be provided with a ridge 524, extending outwardly in a vertical fashion from one end. Similarly, the sole flue wall segments 522 may include a groove 526 that extends inwardly in a vertical fashion at the opposite end. In this manner, opposing sole flue wall segments 522 may be positioned closely adjacent one another so that the ridge 524 of one sole flue wall segment 522 is disposed within the groove 526 of the adjacent sole flue wall segment 522. In addition to, or in place of, the mating ridge 524 and groove 526, the sole flue wall segments 522 may be provided with a notch 528 at one end and a projection 530 that extends from the opposite end. The notch 528 and projection 530 are shaped and positioned so that one sole flue wall segment 522 may couple with an adjacent sole flue wall segment 522 through the interlocking of the notch 528 and the projection 530.

Volatile gases emitted from the coal in the oven are directed to the sole flue 516 through downcommer channels 512, which are fluidly connected to chimneys or uptake channels 514 by the sole flue 516. The volatile gases are directed along a circuitous path along the sole flue 516. With reference to FIG. 5A, the volatile gases exit the downcommer channels 512 and are directed along a fluid pathway through the runs 517. In particular, blocking wall section 532 is positioned to extend transversely between the sole flue wall 520 and the outer sole flue wall 534, between the downcommer channels 512 and the uptake channels 514. In at least one embodiment, a sole flue wall segment 523 includes a ridge 536 that extends outwardly in a vertical fashion from the sole flue wall segment 523. One end of the blocking wall section 532 includes a groove 538 that extends inwardly in a vertical fashion. In this manner, the sole flue wall segment 523 may be positioned closely adjacent the blocking wall section 532 so that the ridge 536 is disposed within the groove 538 to secure the position of the opposing structures with one another. In this manner, the volatile gases are substantially prevented from short circuiting the fluid pathway from the downcommer channels 512 and the uptake channels 514.

Figure 5E:
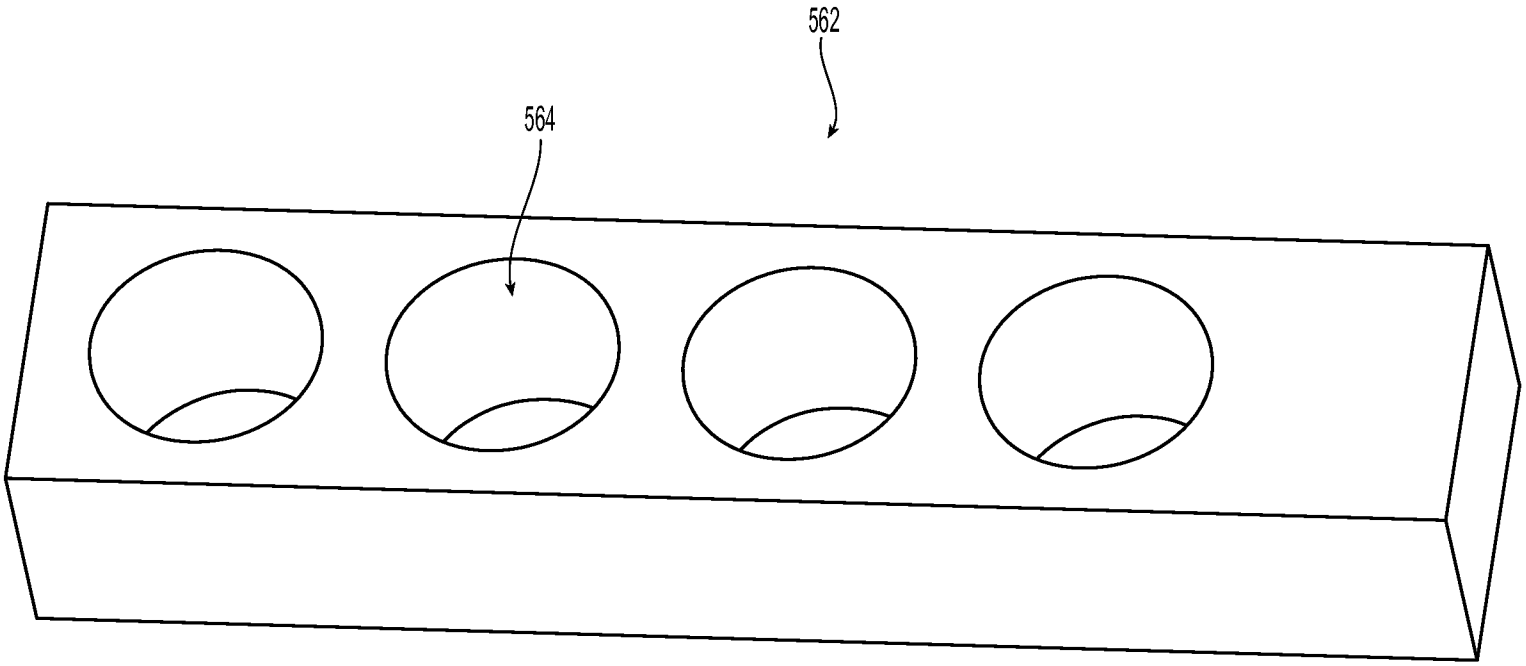
FIG. 5E is an isometric view of an outer sole flue wall section with fluid channels for use with the sole flue shown in FIG. 5A and configured in accordance with embodiments of the technology.
Figure 5F:
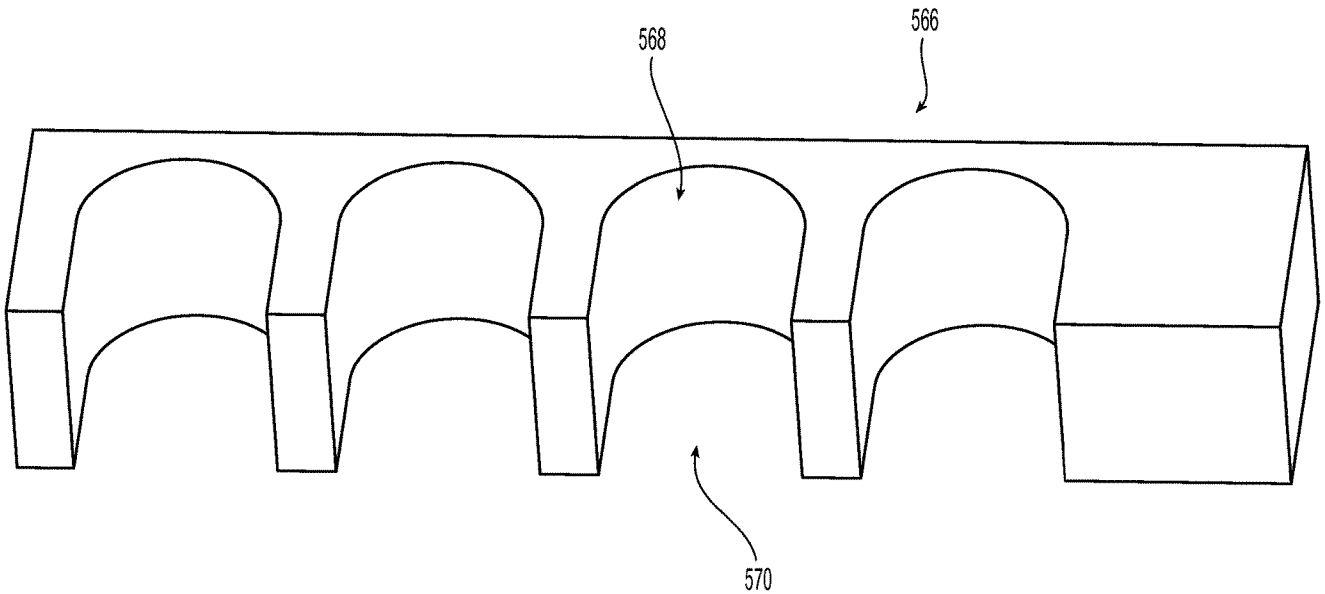
FIG. 5F is an isometric view of another outer sole flue wall section with open fluid channels for use with the sole flue shown in FIG. 5A and configured in accordance with embodiments of the technology.
Figure 5G:
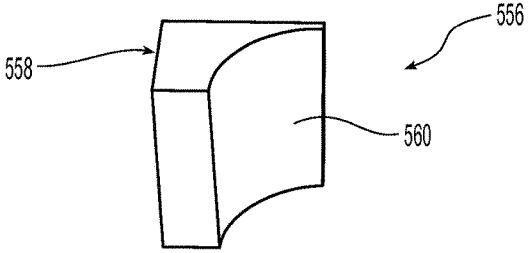
FIG. 5G is an isometric view of a sole flue corner section for use with the sole flue shown in FIG. 5A and configured in accordance with embodiments of the technology.
Figure 5H:
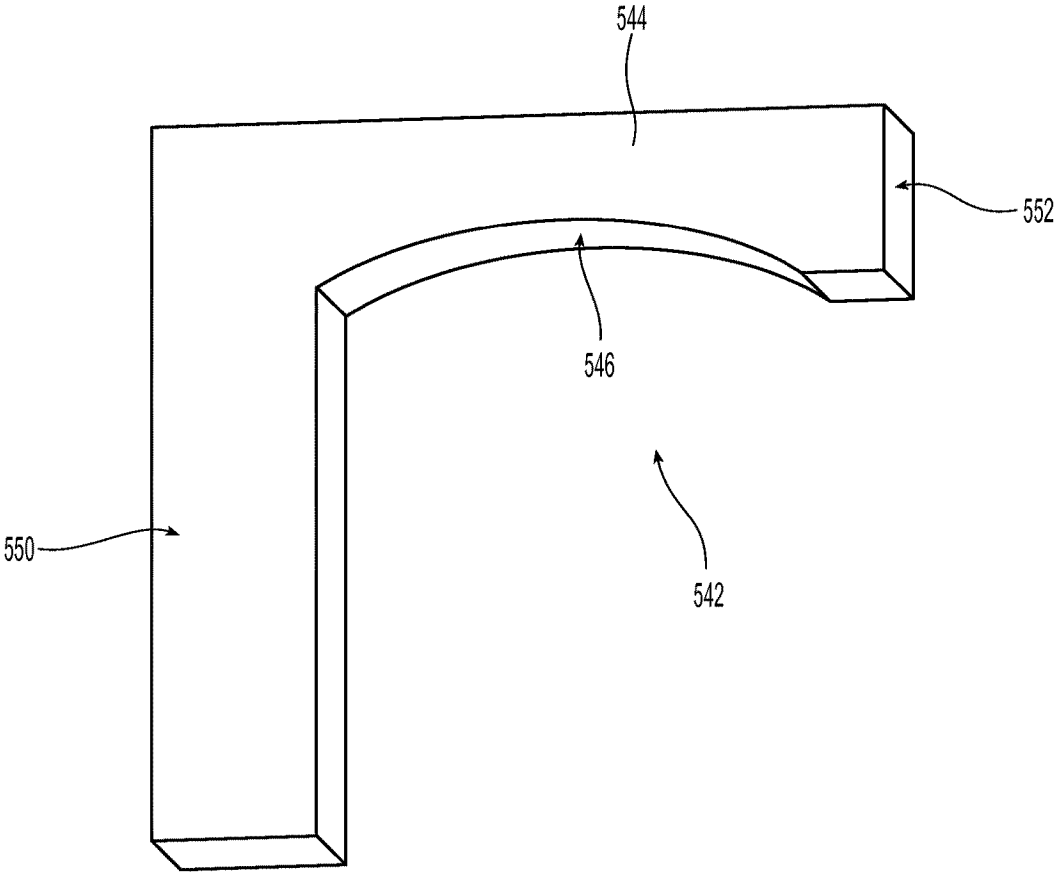
FIG. 5H is an isometric view of an arch support for use with the sole flue shown in FIG. 5A and configured in accordance with embodiments of the technology.

As the volatile gases travel along the fluid pathway through the sole flue 516, they are forced around end portions of the sole flue walls 520, which may stop short of meeting with sole flue end walls 540. The gap between the end portion of the sole flue walls 520 and the sole flue end walls 540 are, in various embodiments, provided with arch sections 542 to span the gap. In some embodiments, the arch sections 542 may be U-shaped, providing a pair of opposing legs to engage the sole flue floor 543 and an upper end portion to engage the oven floor. In other embodiments, the arch section 542 may be an arched or a flat cantilevered section integrated with and extending from the sole flue wall 520. In other embodiments, such as those depicted in FIGS. 5A and 5H, the arch sections 542 are J-shaped, having an upper end portion 544 with an arched lower surface 546 and an upper surface 548 that is shaped to engage the oven floor. A single leg 550 extends downwardly from one end of the upper end portion 544 to engage the sole flue floor 543. A side portion of the leg 550 is positioned closely adjacent the free end portion of the sole flue wall 520. A free end portion 552 of the upper end portion 544, opposite the leg 550, in some embodiments, engages an anchor point 554 on the sole flue wall 520 to support that side of the arch section 542. In some embodiments, the anchor point 554 is a recess or a notch formed in the sole flue wall 520. In other embodiments, the anchor point 554 is provided as a ledge portion of an adjacent structure, such as the sole flue end wall 540. As the volatile gases travel around end portions of the sole flue walls 520, the volatile gases encounter corners, in certain embodiments, where the sole flue end walls 540 meet outer sole flue walls 534 and sole flue walls 520. Such corners present, by definition, opposing surfaces that engage the volatile gases and induce turbulence that disrupt the smooth, laminar flow of the volatile gases. Accordingly, some embodiments of the present technology include sole flue corner sections 556 in the corners to reduce the disruption of the volatile gas flow. With reference to FIG. 5G, embodiments of the sole flue corner sections 556 include an angular rearward face 558 that is shaped to engage the corner areas of the sole flue 516. Opposite, forward faces 560 of the sole flue corner sections 556 are shaped to be curvilinear or concave. In other embodiments the corner section is a curved pocket. In operation, the curvilinear shape reduces dead flow zones and smooths out transitions in flow. In this manner, turbulence in the volatile gas flow may be reduced as the fluid pathway travels the corner areas of the sole flue 516. Top surfaces of the sole flue corner sections 556 may be shaped to engage the oven floor for additional support.

In various prior art coking ovens, the outer sole flue walls are formed from brick. Accordingly, the downcommer channels and the uptake channels that extend through the outer sole flue walls are formed with flat opposing walls that meet at corners. Accordingly, the fluid pathway through the downcommer channels and the uptake channels is turbulent and reduces optimal fluid flow. Moreover, the irregular surfaces of the brick and the angular geometry of the downcommer channels and the uptake channels promote the build-up of debris and particulate over time, which further restricts fluid flow. With reference to FIG. 5A and FIG. 5E, embodiments of the present technology form at least portions of the outer sole flue walls 534 with channel blocks 562. In some embodiments, the channel blocks 562 include one or more channels 564, having open ends that penetrate widths of the channel blocks 562 and closed sidewalls. In other embodiments, channel blocks 566 include one or more open channels 568 that have open ends that penetrate widths of the channel blocks 566 and sidewalls that are open to one side of the channel blocks 566 to define channel openings 570. In various embodiments, the channel blocks 566 are positioned at the sole flue floor level. Channel blocks 562 are positioned on top of the channel blocks 566 so that ends of the channels 564 and ends of the open channels 568 are placed in open fluid communication with one another. In this orientation, the channel openings 570 for one set of channel blocks 566 may serve as the outlet for downcommer channels 512. Similarly, the channel openings 570 for another set of channel blocks 566 may serve as the inlet for the uptake channels 514. More than one channel block 562 may be positioned on top of each channel block 566, depending on the desired height of the outer sole flue wall 534 and the sole flue 516.

Figure 6:
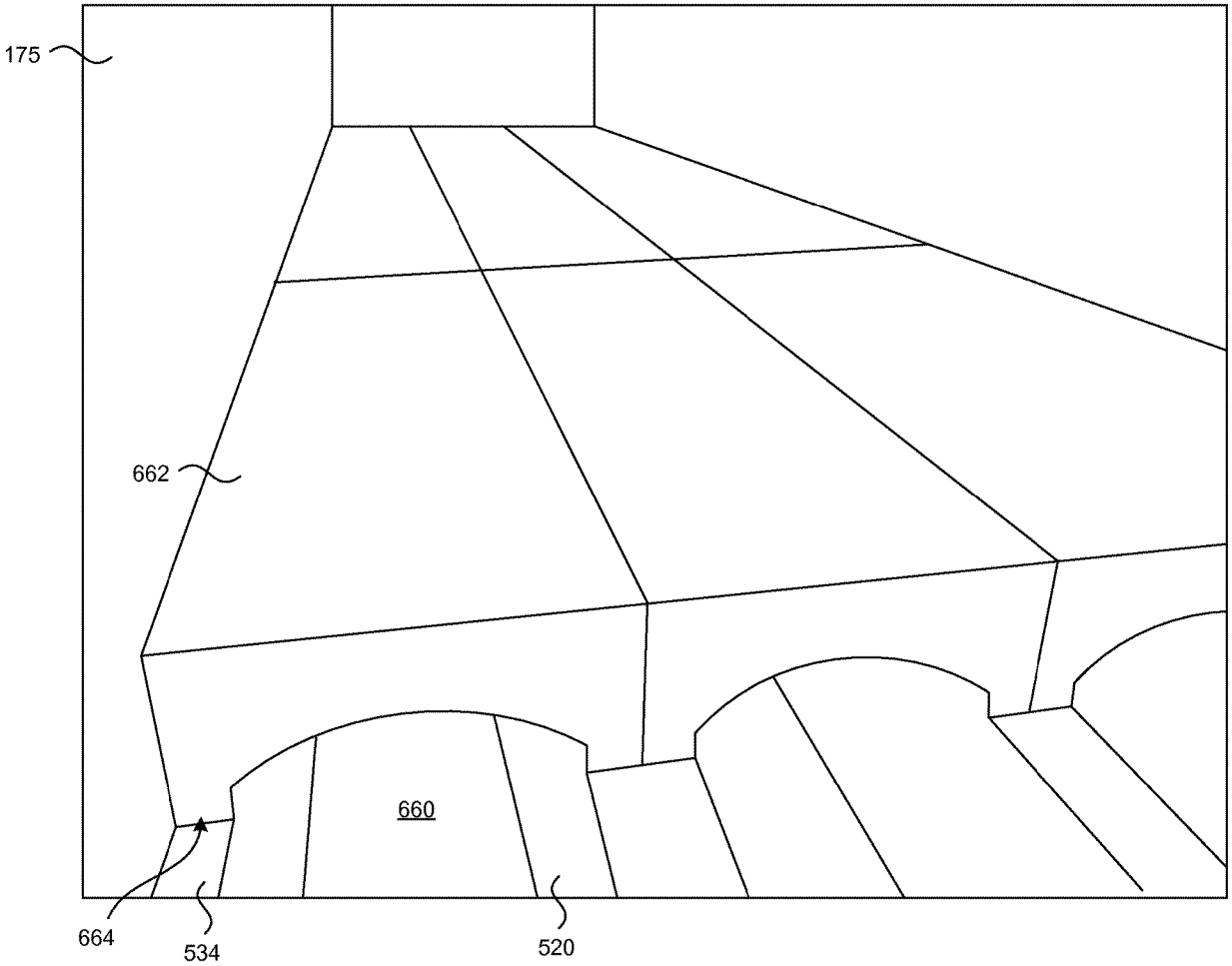
FIG. 6 is a partial isometric view of a monolith crown floor and sole flue portion of a horizontal heat recovery coke oven configured in accordance with embodiments of the technology.

With reference to FIG. 6, the runs 517 of the sole flue 516 may be covered by an oven floor 660, which can comprise multiple monolith segments 662 made of thermally-volume-stable material. In particular, as shown in FIG. 6, a monolith over the sole flue 516 is formed from a plurality of side-by-side arches, each arch covering a run 517 of the sole flue 516. Lower end portions 664 of the monolith segments 662 are positioned on upper surfaces of the sole flue walls 520 and outer sole flue walls 534. According to further aspects, a planar monolith layer or a segmented brick layer may cover the top portion of the monolith segments 662. Further, as discussed previously with regard to other aspects of the present technology, the entire oven may be made of expanding and contracting material so that some or all of the structural components of the oven can expand and contract with one another. Accordingly, if the monolith segments 662, sole flue walls 520, and the outer sole flue walls 534 are made of a thermally-volume-stable material, then the monolith segments 662, sole flue walls 520, and the outer sole flue walls 534 can stay generally aligned with one another upon heating and cooling. It is contemplated, however, that in certain applications, that one or more of the monolith segments 662, sole flue walls 520, and the outer sole flue walls 534 could be made from materials other than thermally-volume-stable material. Such instances may arise during a repair or retrofit of an existing coking oven with precast structural components. It is similarly contemplated that some or all of the other components described herein, such as downcommer cover 118, the blocking wall sections 532, sole flue end walls 540, arch sections 542, sole flue corner sections 556, channel blocks 522, and channel blocks 523 could be formed from a thermally-volume-stable material and/or could be lined with thermally-volume-stable material.

In accordance with aspects of the disclosure, the oven may be constructed of monolith precast interlocking or interfacing shapes forming a precast oven. For example, the monolith crown with integral sidewalls may sit on a precast floor with monolith sole flue walls, thus the entire oven may be constructed of a plurality of precast shapes as shown in FIG. 1A. In alternative embodiments, the entire oven may be constructed of one precast piece. In further embodiments, the oven may be constructed of one or more precast shapes interfacing with individual bricks to form a hybrid oven construction. Aspects of the hybrid oven construction may be particularly efficient in oven repairs as further shown in the figures.

Figure 7:
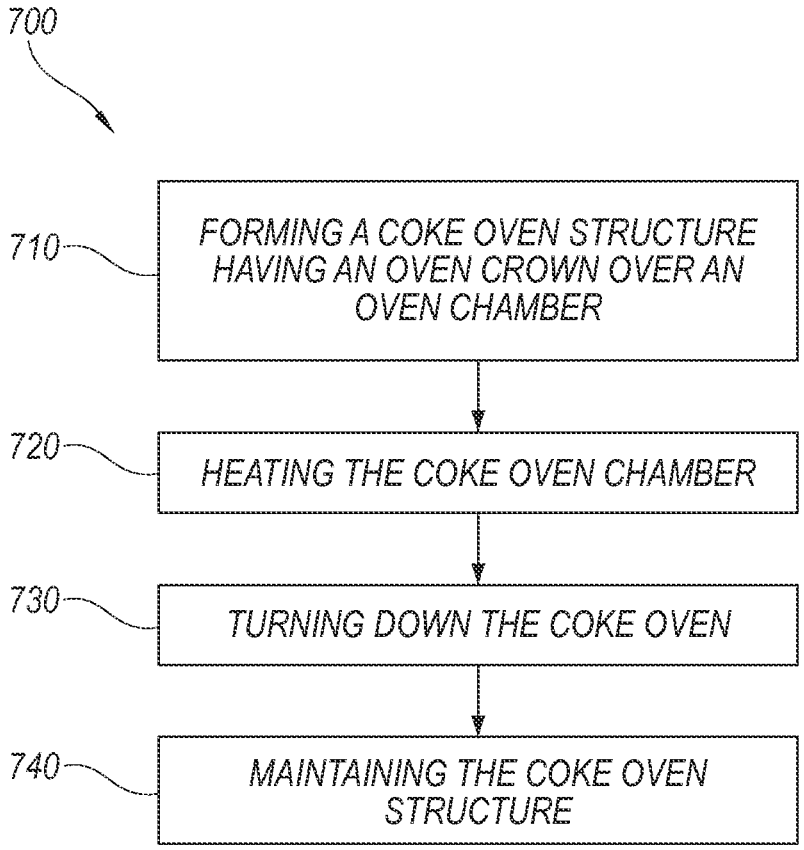
FIG. 7 is a block diagram illustrating a method of turning down a horizontal heat recovery coke oven.

FIG. 7 is a block diagram illustrating a method 700 of turning down a horizontal heat recovery coke oven. The method may include use of a precast monolithic crown to replace brick structures or may include a horizontal coke oven built of precast monolithic sections. At block 710, the method 700 includes forming a coke oven structure having an oven crown over an oven chamber. The crown or precast section may be an oven crown, an upcommer arch, a downcommer arch, a J-piece, a single sole flue arch or multiple sole flue arches, a downcommer cleanout, curvilinear corner sections, and/or combined portions of any of the above sections. In some embodiments, the crown is formed at least in part with a thermally-volume-stable material. In further embodiments, the crown is formed as a monolith (or several monolith segments) spanning between supports such as oven sidewalls.

At block 720, the method 700 includes heating the coke oven chamber. In some embodiments, the oven chamber is heated above the thermally-volume-stable temperature of a given material (e.g., above 1,200° F. in the case of a silica oven). The method 700 then includes turning down the coke oven below a thermally-volume-stable temperature at block 730. For materials having a thermally-volume-stable temperature, like silica, this comprises dropping the oven temperature below this temperature (e.g., below 1,200° F. in the case of a silica oven). For thermally-volume-stable materials, like fused silica, or materials not having a thermally-volume-stable temperature, like alumina, the step of turning down the coke oven below a thermally-volume-stable temperature comprises turning down the oven temperature to any lesser temperature. In particular embodiments, turning down the coke oven comprises turning off the coke oven entirely. In further embodiments, turning down the coke oven comprises turning down the coke oven to a temperature of about 1,200° F. or less. In some embodiments, the coke oven is turned down to 50% or less of the maximum operating capacity. At block 740, the method 700 further includes maintaining the coke oven structure, including the integrity of the oven crown. The oven is thus turned down without crown collapse as experienced in traditional ovens. In some embodiments, the oven is turned down without causing significant crown contraction. The method described above can be applied to a coking chamber, sole flue, downcommer, upcommer or other portion of the oven.

Examples

The following Examples are illustrative of several embodiments of the present technology.

1. A coke oven chamber, comprising:
an oven floor;
a forward end portion and a rearward end portion opposite the forward end portion;
a first sidewall extending vertically upward from the floor between the front wall and the back wall and a second sidewall opposite the first sidewall;
a crown positioned above the floor and spanning from the first sidewall to the second sidewall; and
a sole flue comprising a thermally-volume-stable material and having a plurality of adjacent runs between the first sidewall and the second sidewall.

2. The coke oven chamber of claim 1 wherein the thermally-volume-stable material comprises fused silica or zirconia.

3. The coke oven chamber of claim 1 wherein the sole flue includes at least one sole flue wall comprised of a plurality of sole flue wall segments.

4. The coke oven chamber of claim 3 wherein the sole flue wall segments are comprised of a thermally-volume-stable material.

5. The coke oven chamber of claim 3 wherein the sole flue wall segments are coupled with one another by cooperating ridge and groove features associated with end portions of the sole flue wall segments.

6. The coke oven chamber of claim 3 wherein the sole flue wall segments are coupled with one another by cooperating notch and projection features associated with end portions of the sole flue wall segments.

7. The coke oven chamber of claim 1 wherein the sole flue includes at least one blocking wall section coupled with, and extending generally transverse from, at least one sole flue wall; the at least one blocking wall section comprising of a thermally-volume-stable material.

8. The coke oven chamber of claim 7 wherein the at least one blocking wall section and at least one sole flue wall are coupled with one another by cooperating ridge and groove features associated with an end portion of the at least one blocking wall segment and a side portion of the at least one sole flue wall.

9. The coke oven chamber of claim 1 wherein the sole flue includes at least one generally J-shaped arch section spanning a gap between an end portion of at least one sole flue wall and a sole flue end wall.

10. The coke oven chamber of claim 9 wherein the arch section includes an arched upper end portion and a leg depending from one end of the upper end portion; an opposite free end of the arched upper end portion operatively coupled with the sole flue end wall between a sole flue floor and the oven floor.

11. The coke oven chamber of claim 9 wherein the at least one arch section is comprised of a thermally-volume-stable material.

12. The coke oven chamber of claim 1 wherein the sole flue includes at least one sole flue corner section having a rearward face that is shaped to engage a corner area of at least one of the plurality of adjacent runs and an opposing, curvilinear or concave forward face; the sole flue corner section being positioned to direct fluid flow past the corner area.

13. The coke oven chamber of claim 12 wherein the at least one sole flue corner section is comprised of a thermally-volume-stable material.

14. The coke oven chamber of claim 1 wherein the sole flue includes at least one sole flue corner section having a rearward face that is shaped to engage a corner area of at least one of the plurality of adjacent runs and an opposing, curvilinear or concave forward face; the sole flue corner section being positioned to direct fluid flow past the corner area.

15. The coke oven chamber of claim 1 wherein the oven chamber is further comprised of downcommer channels that extend through at least one of the first sidewall and second sidewall; the downcommer channels being in open fluid communication with the oven chamber and the sole flue.

16. The coke oven chamber of claim 15 wherein the downcommer channels have curved sidewalls.

17. The coke oven chamber of claim 15 wherein the downcommer channels have various geometric shapes cross-sections.

18. The coke oven chamber of claim 15 wherein the downcommer channels are cast using a thermally-volume-stable material.

19. The coke oven chamber of claim 15 wherein the downcommer channels are formed from a plurality of channel blocks having channels that penetrate the channel blocks; the plurality of channel blocks being vertically stacked such that channels from adjacent channel blocks align with one another to define sections of downcommer channels.

20. The coke oven chamber of claim 19 wherein at least one channel block includes channels that penetrate upper and lower end portions of the channel block and a side of the channel block to provide outlets for the downcommer channels.

21. The coke oven chamber of claim 15 further comprising a downcommer cover operatively coupled with an opening to at least one downcommer channel; the downcommer cover including a plug that is shaped to be received within an access opening that penetrates the downcover cover.

22. The coke oven chamber of claim 1 wherein the oven chamber is further comprised of uptake channels that extend through at least one of the first sidewall and second sidewall; the uptake channels being in open fluid communication with the sole flue and a fluid outlet of the coke oven chamber.

23. The coke oven chamber of claim 22 wherein the uptake channels have various geometric shapes sidewalls.

24. The coke oven chamber of claim 22 wherein the uptake channels have various geometric shapes cross-sections.

25. The coke oven chamber of claim 22 wherein the uptake channels are cast using a thermally-volume-stable material.

26. The coke oven chamber of claim 22 wherein the uptake channels are formed from a plurality of channel blocks having channels that penetrate the channel blocks; the plurality of channel blocks being vertically stacked such that channels from adjacent channel blocks align with one another to define sections of uptake channels.

27. The coke oven chamber of claim 26 wherein at least one channel block includes channels that penetrate upper and lower end portions of the channel block and a side of the channel block to provide inlets for the uptake channels.

From the foregoing it will be appreciated that, although specific embodiments of the technology have been described herein for purposes of illustration, various modifications may be made without deviating from the spirit and scope of the technology. For example, while several embodiments have been described in the context of HHR ovens, in further embodiments, the monolith or thermally-volume-stable designs can be used in non-HHR ovens, such as byproduct ovens. Further, certain aspects of the new technology described in the context of particular embodiments may be combined or eliminated in other embodiments. For example, while certain embodiments have been discussed in the context of a crown for a coking chamber, the flat crown, monolith crown, thermally-volume-stable materials, and other features discussed above can be used in other portions of a coke oven system, such as a crown for a sole flue. Moreover, while advantages associated with certain embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein. Thus, the disclosure is not limited except as by the appended claims.

We claim:

1. A horizontal heat recovery coke oven chamber, comprising:

an oven floor;

a forward end portion and a rearward end portion opposite the forward end portion;

a first sidewall extending vertically upward from the floor between the front wall and the back wall and a second sidewall opposite the first sidewall;

a crown positioned above the floor and spanning from the first sidewall to the second sidewall; and a sole flue formed from a thermally-volume-stable material, which is at least one of near-zero-expansion and near-zero-contraction throughout a coking cycle, and having a plurality of adjacent runs between the first sidewall and the second sidewall; at least a portion of the sole flue formed in monolith construction from a sole flue floor to a sole flue crown.

2. The coke oven chamber of claim 1 wherein the thermally-volume-stable material comprises fused silica or zirconia.

3. The coke oven chamber of claim 1 wherein the sole flue includes at least one sole flue wall comprised of a plurality of sole flue wall segments.

4. The coke oven chamber of claim 3 wherein the sole flue wall segments are comprised of a thermally-volume-stable material.

5. The coke oven chamber of claim 3 wherein the sole flue wall segments are coupled with one another by cooperating ridge and groove features associated with end portions of the sole flue wall segments.

6. The coke oven chamber of claim 3 wherein the sole flue wall segments are coupled with one another by cooperating notch and projection features associated with end portions of the sole flue wall segments.

7. The coke oven chamber of claim 1 wherein the sole flue includes at least one blocking wall section coupled with, and extending generally transverse from, at least one sole flue wall; the at least one blocking wall section comprising of a thermally-volume-stable material.

8. The coke oven chamber of claim 7 wherein the at least one blocking wall section and at least one sole flue wall are coupled with one another by cooperating ridge and groove features associated with an end portion of the at least one blocking wall segment and a side portion of the at least one sole flue wall.

9. The coke oven chamber of claim 1 wherein the sole flue includes at least one generally J-shaped arch section spanning a gap between an end portion of at least one sole flue wall and a sole flue end wall.

10. The coke oven chamber of claim 9 wherein the arch section includes an arched upper end portion and a leg depending from one end of the upper end portion; an opposite free end of the arched upper end portion operatively coupled with the sole flue end wall between a sole flue floor and the oven floor.

11. The coke oven chamber of claim 9 wherein the at least one arch section is comprised of a thermally-volume-stable material.

12. The coke oven chamber of claim 1 wherein the sole flue includes at least one sole flue corner section having a rearward face that is shaped to engage a corner area of at least one of the plurality of adjacent runs and an opposing, curvilinear or concave forward face; the sole flue corner section being positioned to direct fluid flow past the corner area.

13. The coke oven chamber of claim 12 wherein the at least one sole flue corner section is comprised of a thermally-volume-stable material.

14. The coke oven chamber of claim 4 wherein the sole flue includes at least one sole flue corner section having a rearward face that is shaped to engage a corner area of at least one of the plurality of adjacent runs and an opposing, curvilinear or concave forward face; the sole flue corner section being positioned to direct fluid flow past the corner area.

15. The coke oven chamber of claim 1 wherein the oven chamber is further comprised of downcommer channels that extend through at least one of the first sidewall and second sidewall; the downcommer channels being in open fluid communication with the oven chamber and the sole flue.

16. The coke oven chamber of claim 15 wherein the downcommer channels have curved sidewalls.

17. The coke oven chamber of claim 15 wherein the downcommer channels have various geometric shapes cross-sections.

18. The coke oven chamber of claim 15 wherein the downcommer channels are cast using a thermally-volume-stable material.

19. The coke oven chamber of claim 15 wherein the downcommer channels are formed from a plurality of channel blocks having channels that penetrate the channel blocks; the plurality of channel blocks being vertically stacked such that channels from adjacent channel blocks align with one another to define sections of downcommer channels.

20. The coke oven chamber of claim 19 wherein at least one channel block includes channels that penetrate upper and lower end portions of the channel block and a side of the channel block to provide outlets for the downcommer channels.

21. The coke oven chamber of claim 15 further comprising a downcommer cover operatively coupled with an opening to at least one downcommer channel; the downcommer cover including a plug that is shaped to be received within an access opening that penetrates the downcover cover.

22. The coke oven chamber of claim 1 wherein the oven chamber is further comprised of uptake channels that extend through at least one of the first sidewall and second sidewall; the uptake channels being in open fluid communication with the sole flue and a fluid outlet of the coke oven chamber.

23. The coke oven chamber of claim 22 wherein the uptake channels have various geometric shapes sidewalls.

24. The coke oven chamber of claim 22 wherein the uptake channels have various geometric shapes cross-sections.

25. The coke oven chamber of claim 22 wherein the uptake channels are cast using a thermally-volume-stable material.

26. The coke oven chamber of claim 22 wherein the uptake channels are formed from a plurality of channel blocks having channels that penetrate the channel blocks; the plurality of channel blocks being vertically stacked such that channels from adjacent channel blocks align with one another to define sections of uptake channels.

27. The coke oven chamber of claim 26 wherein at least one channel block includes channels that penetrate upper and lower end portions of the channel block and a side of the channel block to provide inlets for the uptake channels.

* * * * *